US011105538B2

(12) United States Patent
Maeyama

(10) Patent No.: US 11,105,538 B2
(45) Date of Patent: Aug. 31, 2021

(54) REFRIGERATION CYCLE APPARATUS

(71) Applicant: Mitsubishi Electric Corporation, Tokyo (JP)

(72) Inventor: Hideaki Maeyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 11 days.

(21) Appl. No.: 15/764,899

(22) PCT Filed: Dec. 1, 2015

(86) PCT No.: PCT/JP2015/083751
§ 371 (c)(1),
(2) Date: Mar. 30, 2018

(87) PCT Pub. No.: WO2017/094114
PCT Pub. Date: Jun. 8, 2017

(65) Prior Publication Data

US 2018/0274820 A1 Sep. 27, 2018

(51) Int. Cl.
*F25B 39/04* (2006.01)
*F28F 9/02* (2006.01)
(Continued)

(52) U.S. Cl.
CPC ..... *F25B 1/047* (2013.01); *F25B 1/00* (2013.01); *F25B 39/04* (2013.01); *F28F 9/02* (2013.01);
(Continued)

(58) Field of Classification Search
CPC .... F25B 39/04; F25B 41/003; F25B 2339/04; F25B 2339/0446; F25B 2339/041;
(Continued)

(56) References Cited

U.S. PATENT DOCUMENTS 1,470,033 A * 10/1923 Schenck ..... F28D 1/05308 165/130
3,849,854 A * 11/1974 Mattioli ..... B21D 53/085 29/890.07
(Continued)

FOREIGN PATENT DOCUMENTS

CN 1585879 A 2/2005
CN 102859300 A 1/2013
(Continued)

OTHER PUBLICATIONS

Shigeo et al. (JP3664511B2) , Refrigerant, the refrigerant compressor and refrigeration equipment (Year: 2005).*
(Continued)

*Primary Examiner* — Jianying C Atkisson
*Assistant Examiner* — Miguel A Diaz
(74) *Attorney, Agent, or Firm* — Posz Law Group, PLC

(57) ABSTRACT

A condenser of a refrigeration cycle apparatus includes a first passage, a second passage, and a joint. The first passage connects to the compressor at a first end and is constituted of, at a second end, a first flat heat transfer tube including a plurality of passages thereof. The second passage connects to the expansion device at a first end and is constituted of, at a second end, a second flat heat transfer tube including a plurality of passages thereof. The joint joins the first flat heat transfer tube and the second flat heat transfer tube and bends a flow of the hydrofluoroolefin-based refrigerant between the first flat heat transfer tube and the second flat heat transfer tube. A length of the second passage is equal to or shorter than a length of the first passage. The joint is provided, inside thereof, with a hollow portion.

9 Claims, 17 Drawing Sheets

(B)

(51) Int. Cl.
*F25B 1/00* (2006.01)
*F28F 9/26* (2006.01)
*F25B 1/047* (2006.01)

(52) U.S. Cl.
CPC ..... *F28F 9/0246* (2013.01); *F28F 9/26* (2013.01); *F28F 2009/0287* (2013.01)

(58) Field of Classification Search
CPC ..... F28F 9/0263; F28F 9/0202; F28F 9/0209; F28F 9/26; F28F 2260/02; F28F 9/02; F28F 9/0246; F28F 9/0253; F28F 9/0256; F28F 9/0275; F28F 9/268; F28D 1/0246; F28D 1/0408; F28D 1/04; F28D 1/053; F28D 1/05308; F28D 1/05358; F28D 1/05325; F28D 1/05375
See application file for complete search history.

(56) References Cited

U.S. PATENT DOCUMENTS 5,224,537 A * 7/1993 Potier ..... F28D 1/0475 165/149
5,810,074 A * 9/1998 Hancock ..... B01D 1/04 165/111
6,453,714 B2 * 9/2002 Kido ..... B21D 41/02 72/297
6,722,422 B1 * 4/2004 Feldmeier ..... F28D 7/106 138/114
9,062,236 B2 * 6/2015 Van Horn ..... C09K 5/045
9,551,540 B2 * 1/2017 Jindou ..... F28F 9/0204
2003/0066633 A1 * 4/2003 Lee ..... F28D 1/0417 165/144
2004/0211551 A1 10/2004 Shinmura et al.
2007/0246206 A1 10/2007 Gong et al.
2010/0031505 A1 * 2/2010 Oddi ..... F28D 1/0391 29/890.03
2011/0088883 A1 * 4/2011 de la Cruz ..... F28D 1/05391 165/173
2011/0316271 A1 * 12/2011 Lalam ..... B23K 9/0282 285/179
2012/0011863 A1 * 1/2012 Seeton ..... F25B 9/002 62/77
2012/0144857 A1 * 6/2012 Rached ..... C09K 5/045 62/502
2012/0151959 A1 * 6/2012 Rached ..... C09K 5/045 62/468
2013/0140012 A1 * 6/2013 Al-Otaibi ..... F28F 9/0202 165/174
2014/0070132 A1 3/2014 Fukushima
2015/0059401 A1 * 3/2015 Matsuda ..... F28D 7/16 62/498
2015/0083377 A1 3/2015 Jindou et al.
2015/0168072 A1 * 6/2015 Ueno ..... F24F 13/30 165/144
2015/0226495 A1 * 8/2015 Park ..... F28F 1/128 165/151
2015/0362222 A1 * 12/2015 Matsuda ..... F28D 1/0476 62/324.1
2016/0033182 A1 * 2/2016 Joardar ..... F25B 39/04 62/507
2016/0223265 A1 8/2016 Jindou et al.
2016/0245560 A1 * 8/2016 Higashiiue ..... F28F 9/0246
2016/0245596 A1 8/2016 Higashiiue et al.
2016/0278239 A1 * 9/2016 Chainer ..... H05K 7/20318
2017/0241683 A1 * 8/2017 Ito ..... F28F 9/0243
2017/0241684 A1 * 8/2017 Ito ..... F28F 9/026
2017/0314792 A1 * 11/2017 Jindou ..... F25B 39/00
2017/0343289 A1 11/2017 Jindou et al.
2017/0343290 A1 11/2017 Jindou et al.
2018/0135900 A1 * 5/2018 Jindou ..... F25B 39/00
2018/0274820 A1 * 9/2018 Maeyama ..... F25B 1/047
2018/0320977 A1 * 11/2018 Kawabata ..... B23K 1/0012
2019/0078817 A1 * 3/2019 Nakamura ..... F25B 39/022
2019/0128623 A1 * 5/2019 Maeyama ..... F25B 39/00
2019/0339027 A1 * 11/2019 Takafuji ..... F28D 1/05333
2020/0224942 A1 * 7/2020 Wan ..... F28D 1/05316

FOREIGN PATENT DOCUMENTS

DE 10114300 C1 * 10/2002 ..... F16L 13/147
EP 2 562 490 A1 2/2013
EP 3 051 244 A1 8/2016
GB 2530915 A * 4/2016 ..... C09K 5/045
JP H08-75320 A 3/1996
JP H10-300286 A 11/1998
JP 3664511 B2 * 6/2005 ..... C09K 5/04
JP 4055449 B2 * 3/2008 ..... F28D 1/0408
JP 4180801 B2 * 11/2008 ..... F28D 1/05391
JP 2013-029243 A 2/2013
JP 5195733 B2 * 5/2013 ..... F28F 1/325
JP 2013-231535 A 11/2013
JP 2015-055408 A 3/2015
JP 2015-078830 A 4/2015
JP 2015-078833 A 4/2015
KR 10-2010-0060442 A 6/2010
WO WO-2009000581 A1 * 12/2008 ..... F28D 1/0408
WO 2012/157764 A1 11/2012
WO 2015/045105 A1 4/2015
WO 2015/046275 A1 4/2015
WO 2015/063857 A1 5/2015
WO 2015/063858 A1 5/2015

OTHER PUBLICATIONS

International Search Report dated Feb. 23, 2016 issued in corresponding international patent application No. PCT/JP2015/083751 (and English translation).
Office action dated Sep. 25, 2018 issued in corresponding JP patent application No. 2017-553532 (and English translation thereof).
Extended European Search Report dated Nov. 2, 2018 issued in corresponding EP patent application No. 15909744.3.
Office Action dated Oct. 31, 2019 issued in corresponding CN patent application No. 201580084781.X (and English translation).

* cited by examiner (A)

(B)

(A)

(B)

(A)

(B)

REFRIGERATION CYCLE APPARATUS

CROSS REFERENCE TO RELATED APPLICATION

This application is a U.S. national stage application of PCT/JP2015/083751 filed on Dec. 1, 2015, the contents of which are incorporated herein by reference.

TECHNICAL FIELD

The present invention relates to a refrigeration cycle apparatus for which a hydrofluoroolefin-based refrigerant is used.

BACKGROUND ART

In recent years, there have been demands for reduction in greenhouse effect gas from the viewpoint of preventing global warming. Regarding refrigerant used for refrigeration cycle apparatuses such as air conditioning apparatuses, refrigerant having a smaller global warming potential (GWP) has been researched. The GWP of R410A, which is widely used for air conditioning apparatuses today, is 2088, that is, a very large value. The GWP of difluoromethane (R32), which has recently started to be introduced, is 675, that is, also a considerably large value.

Examples of refrigerant having a low GWP include natural refrigerants such as carbon dioxide (R744: GWP=1), ammonia (R717: GWP=0), and propane (R290: GWP=6). However, these refrigerants have the following problems.

- R744: Operating pressure is very high. Thus, there is a problem of ensuring the pressure resistance. Furthermore, since the critical temperature is 31 degrees centigrade, that is, low, there is a problem of ensuring the performance for application in air conditioning apparatuses.
- R717: Since R717 is highly toxic, there is a problem of ensuring safety.
- R290: Since R290 is highly flammable, there is a problem of ensuring safety.

Accordingly, in recent years, a hydrofluoroolefin-based refrigerant (HFO refrigerant) that has a single double bond in its composition has become a focus of attention among fluorohydrocarbon. Examples of the HFO refrigerant include, for example, 2,3,3,3-tetrafluoropropene (HFO-1234yf: GWP=4), 1,3,3,3-tetrafluoropropene (HFO-1234ze: GWP=6), 1,1,2-trifluoroethene (HFO-1123: GWP<1), and so forth. These HFO refrigerants have low GWPs comparable to natural refrigerant. When any one of these refrigerants is used alone or in combination with an HFC refrigerant such as R32, the effect of reducing greenhouse effect gas can be expected. Among these, high performance can be expected with a mixed refrigerant using HFO-1123 (see, for example, Patent Literature 1).

Furthermore, heat exchangers using flat heat transfer tubes used for, for example, stationary air conditioning apparatuses have recently become a focus of attention. The section of the flat heat transfer tubes has a flat shape such as, for example, a rectangular shape or an elliptical shape. The flat heat transfer tubes each have a plurality of passages therein through which refrigerant flows. Since the number of heat transfer paths is larger in the flat heat transfer tube than in a circular-tube-shaped heat transfer tube, the flat heat transfer tube has an advantage in that the heat transfer characteristics are improved. Furthermore, the flat heat transfer tube, which has a flat shape in section, also has an advantage in that air duct resistance of the heat exchanger can be reduced. Accordingly, the effect of improvement in performance of air conditioning apparatuses is larger with the flat heat transfer tube than with a circular-tube-shaped heat transfer tube. In many cases, flat heat transfer tubes are formed of an aluminum alloy from the viewpoint of workability. Furthermore, bending of the flat heat transfer tubes is difficult because of, for example, collapse of inner passages. Accordingly, in the heat exchanger using the flat heat transfer tubes, when bending a passage in the heat exchanger, a structure is used in which end portions of the flat heat transfer tubes are connected to each other by a joint, thereby bending the passage at a portion of the joint.

CITATION LIST

Patent Literature

Patent Literature 1: International Publication No. 2012/157764

SUMMARY OF INVENTION

Technical Problem

Although the HFO refrigerant has a low GWP, the atmospheric lifetime of the HFO refrigerant is short (HFO-1234yf: 11 days, HFO-1123: 1.6 days) and the HFO refrigerant is likely to decompose. When the HFO refrigerant decomposes, fluorine components are produced. These fluorine components are likely to react with surrounding parts and additives to refrigerating machine oil or the like and become sludge. The decomposition reaction of the refrigerant occurs in a sliding portion of a compressor, the temperature of which is generally likely to increase. The sludge produced here circulates through a refrigeration cycle circuit together with the refrigerant and the refrigerating machine oil. Typically, the sludge has such characteristics that the sludge dissolves in the refrigerant and the refrigerating machine oil at high temperatures and is deposited in low-temperature portions. In the refrigeration cycle circuit, examples of portions where the temperature changes from high to low include, for example, a region from around the center to a downstream portion relative to the center (portion where a subcooling device is attached) of a passage of a condenser.

Although the effect of improvement in performance with the flat heat transfer tubes is large as described above, individual passages are finely structured. Accordingly, when the heat exchanger using the flat heat transfer tubes is used for the refrigeration cycle circuit into which the HFO refrigerant is charged, there is a problem in that the passages of the flat heat transfer tubes are clogged with the deposited sludge.

The present invention is made to address the above-described problem. An object of the present invention is to obtain a refrigeration cycle apparatus in which, even when a heat exchanger using flat heat transfer tubes is used for a refrigeration cycle circuit into which HFO refrigerant is charged, clogging of passages of the flat heat transfer tubes can be suppressed.

Solution to Problem

A refrigeration cycle apparatus according an embodiment of the present invention includes a refrigeration cycle circuit and hydrofluoroolefin-based refrigerant. The refrigeration cycle circuit includes a compressor, a condenser, and an expansion device. The hydrofluoroolefin-based refrigerant is charged into the refrigeration cycle circuit. The condenser includes a first passage, a second passage, and a joint. The first passage connects to the compressor at a first end and is constituted of, at a second end, a first flat heat transfer tube that includes a plurality of passages thereof. The second passage connects to the expansion device at a first end and is constituted of, at a second end, a second flat heat transfer tube that includes a plurality of passages thereof. The joint joins the first flat heat transfer tube and the second flat heat transfer tube and bends a flow of the hydrofluoroolefin-based refrigerant between the first flat heat transfer tube and the second flat heat transfer tube. A length of the second passage is equal to or shorter than a length of the first passage. The joint is provided, inside thereof, with a hollow portion.

Advantageous Effects of Invention

The passage of the condenser according to an embodiment of the present invention includes the first passage including the first flat heat transfer tube, the joint, and the second passage including the second flat heat transfer tube. These first and second passages and joint are serially connected. In this structure, the joint is positioned at a central portion of the passage of the condenser or a downstream portion relative to the center of the passage of the condenser. Thus, the deposited sludge can be accumulated in the hollow portion of the joint according to the embodiment of the present invention. Accordingly, in the refrigeration cycle apparatus according to the embodiment of the present invention, clogging of the passages of the first flat heat transfer tube and the second flat heat transfer tube with the deposited sludge can be suppressed.

DESCRIPTION OF EMBODIMENTS

Embodiment 1

Figure 1:
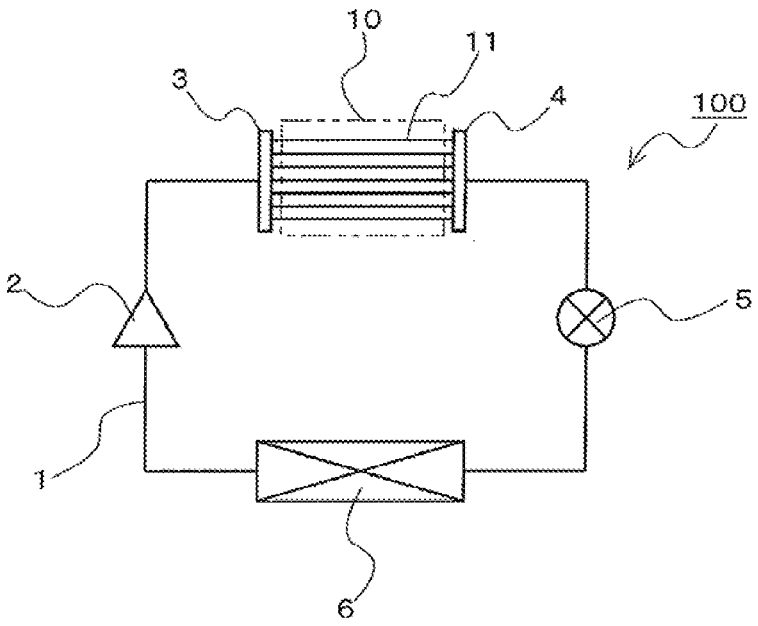
FIG. 1 illustrates a refrigeration cycle circuit 1 of a refrigeration cycle apparatus 100 according to Embodiment 1 of the present invention.

FIG. 1 illustrates a refrigeration cycle circuit 1 of a refrigeration cycle apparatus 100 according to Embodiment 1 of the present invention. The refrigeration cycle circuit 1 includes a compressor 2, a condenser 10, an expansion device 5, and an evaporator 6. These parts of the refrigeration cycle circuit 1 are sequentially connected through refrigeration tubes.

The compressor 2 sucks refrigerant and compresses the sucked refrigerant to produce high-temperature high-pressure gas refrigerant. The type of the compressor 2 is not particularly limited. For example, the compressor 2 may include any of various types of compressors such as a reciprocating compressor, a rotary compressor, a scrolling compressor, and a screw compressor. It is desirable that the compressor 2 be of a type the rotation speed of which can be variably controllable with an inverter.

The condenser 10 causes heat to be exchanged between the refrigerant flowing therethrough and air or another heat-exchanging target. The condenser 10 is, for example, a fin-tube type heat exchanger. Here, the condenser 10 according to Embodiment 1 has a plurality of passages 11 arranged parallel to one another. Thus, ends of the passages 11 on one side, that is, end portions of the passages 11 on the compressor 2 side are connected to a gas header 3, which is connected to a discharge side of the compressor 2. Furthermore, the other ends of these passages 11 are connected to a liquid header 4, which is connected to the expansion device 5. That is, a flow of the high-temperature high-pressure gas refrigerant discharged from the compressor 2 is divided into flows by the gas header 3 to flow through the passages 11 of the condenser 10. Furthermore, the flows of the refrigerant flowing from the passages 11 are merged into a flow at the liquid header 4, and then, the merged flow flows into the expansion device 5. The ends of the passages 11 on the one side may be directly connected to the discharge side of the compressor 2 through a branch tube or the like. Furthermore, the other ends of the passages 11 may be directly connected to the expansion device 5 through a branch tube or the like. The detailed structure of the condenser 10 will be described later.

The expansion device 5 is, for example, an expansion valve that reduces the pressure of the refrigerant to expand the refrigerant. The evaporator 6 causes heat to be exchanged between the refrigerant flowing therethrough and air or another heat-exchanging target. The evaporator 6 is, for example, a fin-tube type heat exchanger.

A hydrofluoroolefin-based refrigerant (HFO refrigerant) that has a single double bond in its composition is charged into the refrigeration cycle circuit 1 structured as described above. Examples of the HFO refrigerant include, for example, 2,3,3,3-tetrafluoropropene (HFO-1234yf: GWP=4), 1,3,3,3-tetrafluoropropene (HFO-1234ze: GWP=6), 1,1,2-trifluoroethene (HFO-1123: GWP<1), and so forth. Here, a single HFO refrigerant alone may be charged into the refrigeration cycle circuit 1 according to Embodiment 1. Alternatively, a mixture of a plurality of HFO refrigerants or mixed refrigerant produced by mixing the single HFO refrigerant or the mixture of the HFO refrigerants with difluoromethane (R32) or the like may be charged into the refrigeration cycle circuit 1 according to Embodiment 1. That is, it is sufficient that at least one of the HFO refrigerants be charged into the refrigeration cycle circuit 1 according to Embodiment 1.

[Detailed Structure of the Condenser 10]

Figure 2:
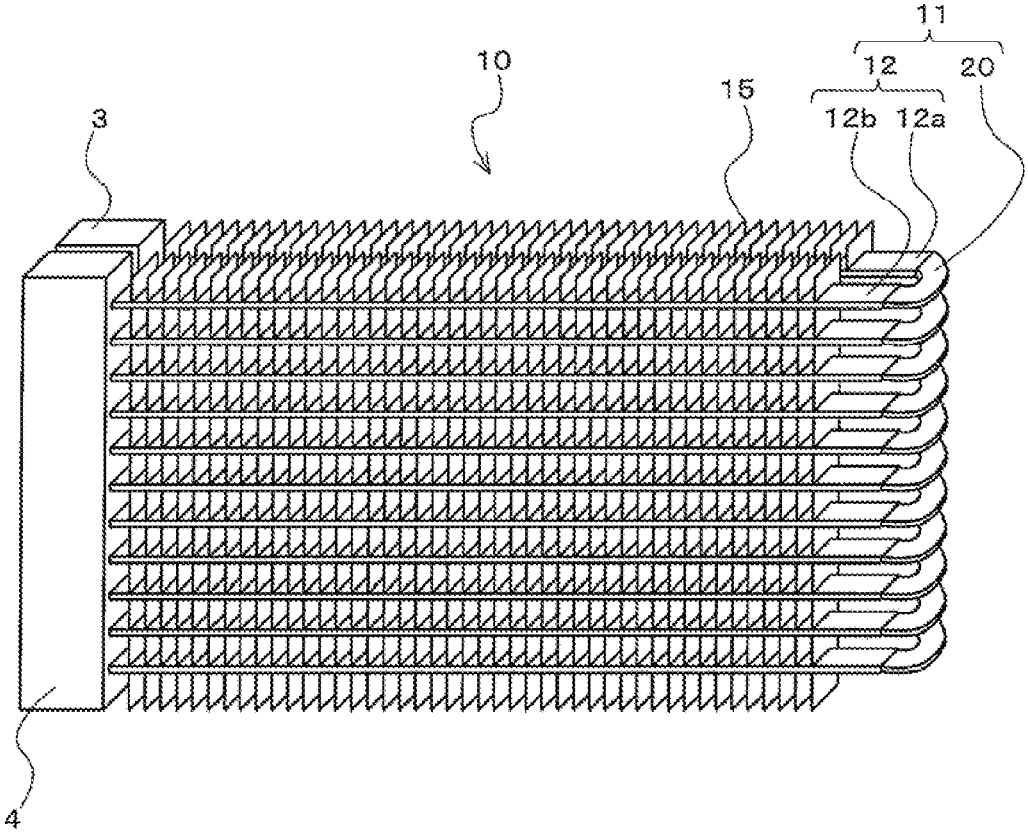
FIG. 2 is a perspective view illustrating a condenser 10, a gas header 3, and a liquid header 4 according to Embodiment 1 of the present invention.
Figure 3:
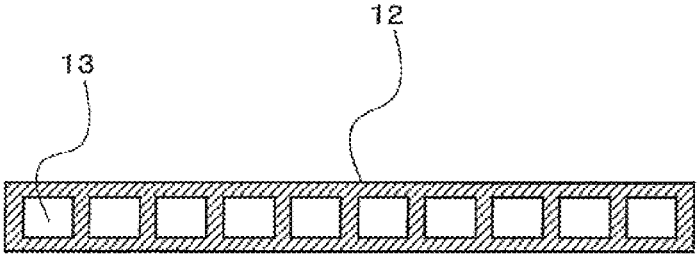
FIG. 3 is a sectional view of a flat heat transfer tube 12 of the condenser 10 according to Embodiment 1 of the present invention taken along a section perpendicular to passages.
Figure 4:
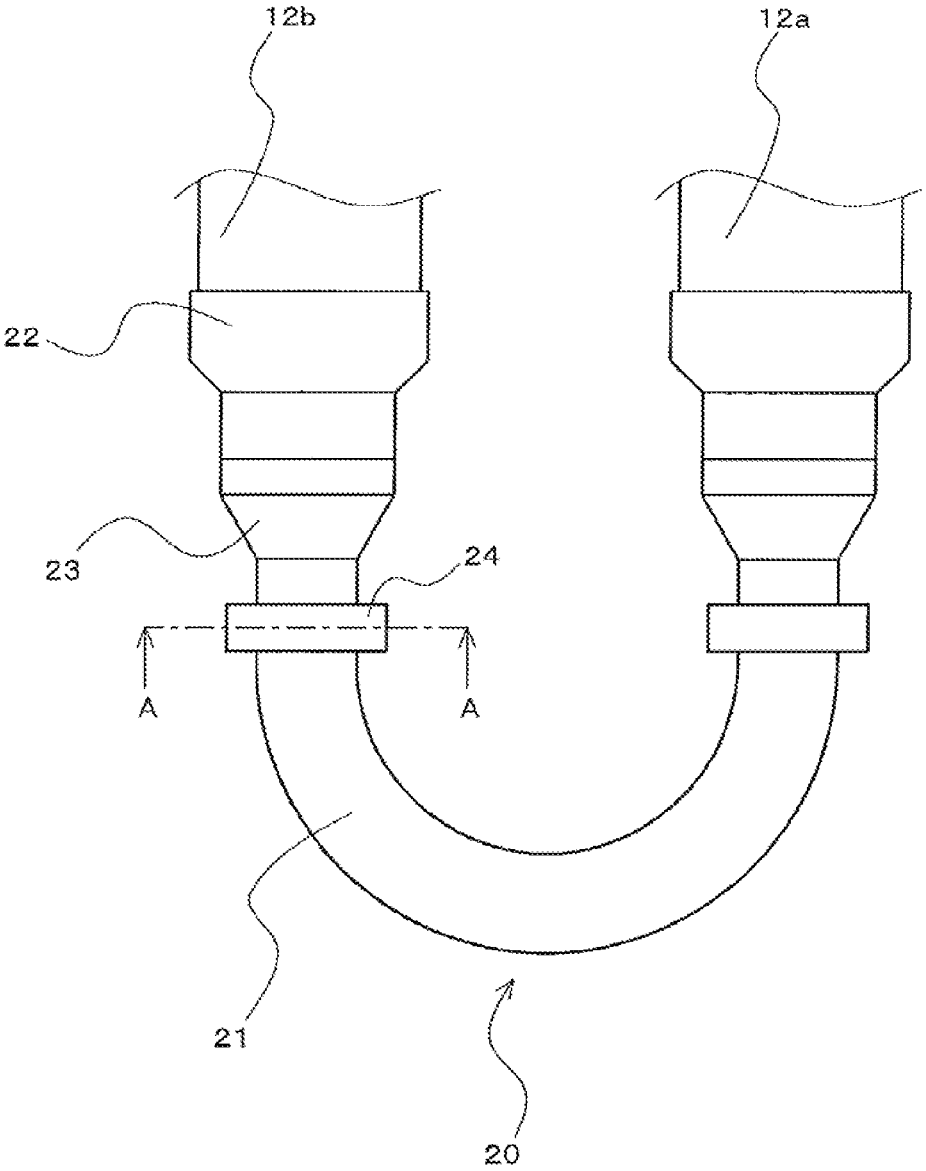
FIG. 4 is a plan view of a joint 20 of the condenser 10 according to Embodiment 1 of the present invention.
Figure 5:
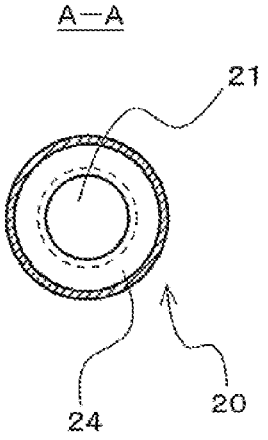
FIG. 5 is a sectional view taken along line A-A illustrated in FIG. 4.

FIG. 2 is a perspective view illustrating the condenser 10, the gas header 3, and the liquid header 4 according to Embodiment 1 of the present invention. FIG. 3 is a sectional view of a flat heat transfer tube 12 of the condenser 10 according to Embodiment 1 of the present invention taken along a section perpendicular to passages 13. FIG. 4 is a plan view of a joint 20 of the condenser 10 according to Embodiment 1 of the present invention. FIG. 5 is a sectional view taken along line A-A illustrated in FIG. 4.

In the following description of the condenser 10, when it is wished that the flat heat transfer tube 12 upstream of the joint 20 and the flat heat transfer tube 12 downstream of the joint 20 be distinguished from each other, the flat heat transfer tube 12 upstream of the joint 20 may be referred to as a flat heat transfer tube 12*a* and the flat heat transfer tube 12 downstream of the joint 20 may be referred to as a flat heat transfer tube 12*b*. That is, the flat heat transfer tube 12 having a first end portion connected to the discharge side of the compressor 2 through the gas header 3 and a second end portion connected to the joint 20 may be referred to as the flat heat transfer tube 12*a*. Furthermore, the flat heat transfer tube 12 having a first end portion connected to the expansion device 5 through the liquid header 4 and a second end portion connected to the joint 20 may be referred to as the flat heat transfer tube 12*b*.

The condenser 10 according to Embodiment 1 includes a plurality of flat heat transfer tubes 12, a plurality of fins 15, and a plurality of joints 20. As illustrated in FIG. 3, the inside of each of the flat heat transfer tubes 12 is separated by partitions, thereby a plurality of the passages 13 communicating in the longitudinal direction of the flat heat transfer tube 12 are formed.

The flat heat transfer tubes 12*a*, which are some of the flat heat transfer tubes 12, are arranged in the up-down direction so as to be spaced apart from one another with a specified gap therebetween. The first end portion of each of the flat heat transfer tubes 12*a* is connected to the gas header 3. Furthermore, the plurality of fins 15 are mounted on the flat heat transfer tube 12*a* such that the fins 15 are arranged in the longitudinal direction of the flat heat transfer tube 12*a* so as to be spaced apart from one another with a specified gap therebetween.

The flat heat transfer tubes 12*b*, which are the flat heat transfer tubes 12 other than the flat heat transfer tubes 12*a*, are arranged in the up-down direction so as to be spaced apart from one another with a specified gap therebetween. An aggregation of the arranged flat heat transfer tubes 12*b* is disposed at a side, in the horizontal direction, of an aggregation of the arranged above-described flat heat transfer tubes 12*a*. Furthermore, the first end portions of these flat heat transfer tubes 12*b* are connected to the liquid header 4. Furthermore, the plurality of fins 15 are mounted on the flat heat transfer tube 12*b* such that the fins 15 are arranged in the longitudinal direction of the flat heat transfer tube 12*b* so as to be spaced apart from one another with a specified gap therebetween.

Of the flat heat transfer tubes 12 disposed as described above, the flat heat transfer tubes 12*b* are arranged beside the flat heat transfer tubes 12*a*. The second end portions of the flat heat transfer tubes 12*a* and the second end portions of the flat heat transfer tubes 12*b* arranged in the horizontal direction are connected through the joints 20. That is, the passages 11 of the condenser 10 includes the flat heat transfer tubes 12*a*, the joints 20, and the flat heat transfer tubes 12*b* connected to one another. Furthermore, flows of the refrigerant are bent by 180 degrees by the joints 20 in the passages 11. The passages 11 structured as described above are arranged in the up-down direction so as to be spaced apart from one another with a specified gap therebetween. Since the length of the flat heat transfer tubes 12*a* and the length of the flat heat transfer tubes 12*b* are the same, the joints 20 are positioned at the centers in the passages 11 of the condenser 10.

Here, each of the flat heat transfer tubes 12*a* corresponds to a first flat heat transfer tube and a first passage of the present invention. Each of the flat heat transfer tubes 12*b* corresponds to a second flat heat transfer tube and a second passage of the present invention.

As illustrated in FIGS. 4 and 5, each of the joints 20 that connects a corresponding one of the flat heat transfer tubes 12*a* and a corresponding one of the flat heat transfer tubes 12*b* to one another is a U-shaped tube having a substantially U-shape in plan view. A central portion of the joint 20 is a circular tube portion 21 having a circular tube shape. Furthermore, both end portions of the joint 20 have respective flat portions 22 having a flat shape that is substantially the same as the shape of the section of the flat heat transfer tube 12. The joint 20 and the flat heat transfer tubes 12 are connected to one another by, for example, inserting end portions of the flat heat transfer tubes 12 into the flat portions 22 and, performing brazing or the like. Furthermore, a shape-changing portion 23 is formed between the circular tube portion 21 and each of the flat portions 22. The sectional shape of the shape-changing portion 23 gradually changes from a circular shape to a flat shape. Furthermore, hollow portions 24 are formed in, for example, the circular tube portion 21 of the joint 20. The hollow portions 24 are concaved relative to a region around the hollow portions 24. The hollow portions 24 are each formed throughout the circumference of the circular tube portion 21.

[Description of Operation]

Next, operation of the refrigeration cycle apparatus 100 formed as described above is described.

The gas refrigerant sucked into the compressor 2 is compressed by the compressor 2 and becomes high-temperature gas refrigerant. Here, although the HFO refrigerant has a low GWP, an atmospheric lifetime of the HFO refrigerant is short (HFO-1234yf: 11 days, HFO-1123: 1.6 days) and the HFO refrigerant is likely to decompose. Furthermore, the decomposition reaction of the HFO refrigerant occurs in a sliding portion of the compressor where the temperature is generally likely to increase. Fluorine components produced by the decomposition of the HFO refrigerant react with surrounding parts and additives to refrigerating machine oil or the like and become sludge. This sludge dissolves in the refrigerant and the refrigerating machine oil at high temperatures. Thus, the high-temperature high-pressure gas refrigerant discharged from the compressor 2 flows into the condenser 10 with the sludge that dissolves therein.

The high-temperature gas refrigerant discharged from the compressor 2 flows into the passages 11 of the condenser 10 through the gas header 3. The gas refrigerant flowing into the passages 11 is cooled by the heat exchange target such as air supplied to the condenser 10 and being condensed. Particularly, the temperature of the gas refrigerant flowing into the passages 11 of the condenser 10 changes as follows.

Figure 6:
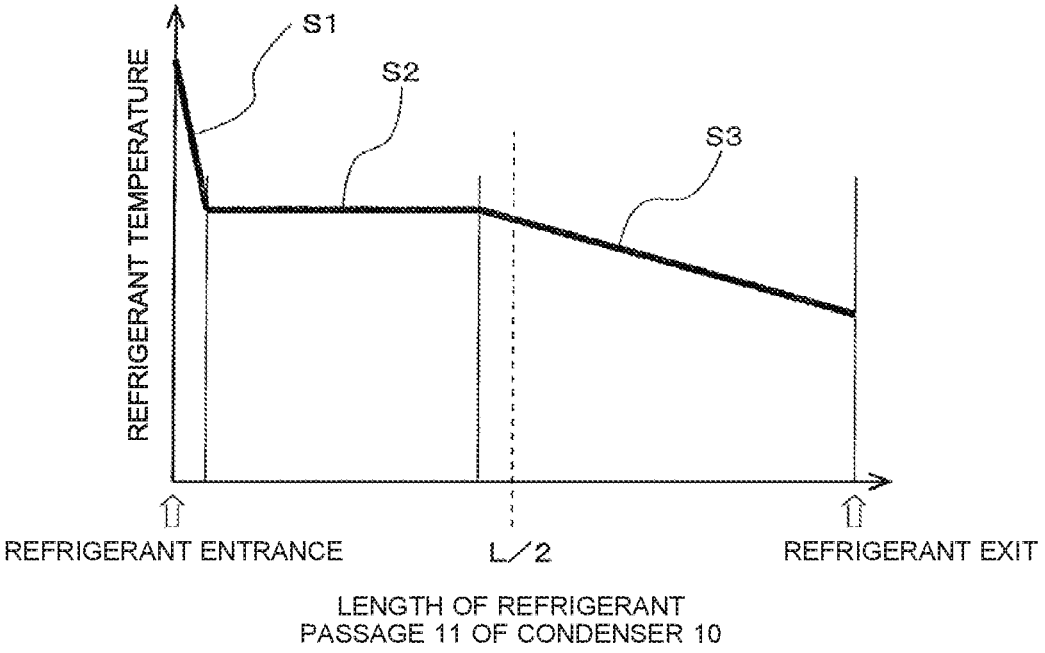
FIG. 6 illustrates the temperature change of the refrigerant flowing through a passage 11 of the condenser 10 according to Embodiment 1 of the present invention.

FIG. 6 illustrates the temperature change of the refrigerant flowing through each of the passages 11 of the condenser 10 according to Embodiment 1 of the present invention. A refrigerant entrance illustrated in the horizontal axis of FIG. 6 indicates an end portion of the flat heat transfer tube 12*a* on the gas header 3 side. A refrigerant exit illustrated in FIG. 6 indicates an end portion of the flat heat transfer tube 12*b* on the liquid header 4 side. Furthermore, L/2 illustrated in FIG. 6 indicates an intermediate position of the passage 11, that is, the position of the joint 20.

The refrigerant immediately after entering the passage 11 of the condenser 10 is gaseous. Accordingly, the temperature of the refrigerant reduces as the refrigerant is cooled by the heat exchange target such as air (state S1 illustrated in FIG. 6). Then, when the refrigerant becomes a two-phase gas-liquid state, the refrigerant is condensed at a constant temperature (state S2 illustrated in FIG. 6). When the refrigerant is condensed more and becomes a liquid state, the temperature reduces again as the refrigerant is cooled by the heat exchange target such as air (state S3 illustrated in FIG. 6). Hereafter, a state in which the temperature of the refrigerant in a liquid state reduces in the passage 11 is referred to as a subcooling state.

As described above, the sludge dissolves in the refrigerant and the refrigerating machine oil at high temperatures. As the refrigerant and the refrigerating machine oil are cooled, the sludge is no longer able to dissolve in the refrigerant and the refrigerating machine oil and deposited. That is, when the refrigerant is in the subcooling state in the passage 11 of the condenser 10, the sludge is likely to be deposited. As illustrated in FIG. 6, in the passage 11, the refrigerant becomes the subcooling state at a position slightly upstream of a central portion (near the center) of the passage 11 in a refrigerant flowing direction. Accordingly, in the passage 11 of the condenser 10, the sludge is likely to be produced in a range from a position slightly upstream of the central portion of the passage 11, that is, slightly upstream of the joint 20 toward a position on the downstream side of the passage 11. Thus, the passages 13 of the flat heat transfer tube 12*b* positioned downstream of the joint 20 may be clogged with the deposited sludge. Furthermore, when the refrigerant flowing from the condenser 10 returns to the condenser 10 with the sludge, the passages 13 of the flat heat transfer tube 12*a* may be clogged with this sludge.

However, in the condenser 10 according to Embodiment 1, the joint 20 is disposed at a position where the sludge is likely to be deposited, and the joint 20 has the hollow portions 24. Accordingly, in the passage 11 of the condenser 10, the sludge deposited upstream of the joint 20 precipitates in the refrigerant and is accumulated at lower portions of the hollow portions 24 of the joint 20. Thus, the sludge is removed from the refrigerant and the refrigerating machine oil circulating through the refrigeration cycle circuit 1. Furthermore, depending on the flow velocity of the refrigerant flowing through the joint 20, the deposited sludge may flow outward due to the centrifugal force when the refrigerant flowing through the joint 20 turns and be accumulated at a portion of the hollow portion 24 that is on the outside of a point where the refrigerant turns. Furthermore, when the sludge deposited downstream of the joint 20 returns to the passage 11 of the condenser 10 after the sludge has circulated through the refrigeration cycle circuit 1, the sludge is accumulated in the hollow portions 24 of the joint 20. Thus, the sludge is removed from the refrigerant and the refrigerating machine oil circulating through the refrigeration cycle circuit 1. Accordingly, in the refrigeration cycle apparatus 100 according to Embodiment 1, clogging of the passages 13 of the flat heat transfer tubes 12 of the condenser 10 with the sludge can be suppressed.

The flows of the refrigerant in the liquid state flowing from the passages 11 of the condenser 10 are merged into a flow at the liquid header 4, and then, the merged flow flows into the expansion device 5 and expands. When the refrigerant expands, the temperature of the refrigerant is further reduced, thereby the refrigerant becomes the two-phase gas-liquid state. The refrigerant in the two-phase gas-liquid state flowing from the expansion device 5 flows into the evaporator 6. The refrigerant in the two-phase gas-liquid state flowing into the evaporator 6 is heated by the heat exchange target such as air supplied to the evaporator 6 and evaporated. Then, the refrigerant flowing from the evaporator 6 is sucked into the compressor 2 again.

As has been described, in the refrigeration cycle apparatus 100 according to Embodiment 1, the deposited sludge can be accumulated in the hollow portions 24. Thus, clogging of the passages 13 of the flat heat transfer tubes 12 of the condenser 10 with the sludge can be suppressed.

Here, it may be thought that a filter is provided at a position in the refrigeration cycle circuit 1 to capture the deposited sludge with the filter. However, with this method, it is required that the filter be disposed at a position that is a single position where the flows of the refrigerant concentrate. Thus, a life until the filter is clogged, that is, the life of the refrigeration cycle apparatus is short. In contrast, with the hollow portions 24 provided in the joints 20 as is the case with Embodiment 1, the deposited sludge can be accumulated on a passage 11-by-passage 11 basis of the condenser 10. Accordingly, an effect of increasing the life of the refrigeration cycle apparatus 100 can also be obtained with the refrigeration cycle apparatus 100 structured as in Embodiment 1.

According to Embodiment 1, as illustrated in FIGS. 4 and 5, the hollow portions 24 are formed at both end portions of the circular tube portion 21 of each of the joints 20. However, as long as the circular tube portion 21 has the hollow portion 24 at one of its end portions, the sludge can be accumulated in this hollow portion 24. Thus, clogging of the passages 13 of the flat heat transfer tubes 12 of the condenser 10 with the sludge can be suppressed. Furthermore, the hollow portions 24 are not necessarily formed in the circular tube portions 21 of the joints 20. The hollow portions 24 may be formed in the flat portions 22 or the shape-changing portions 23. Also with the joints 20 structured as described above, the sludge can be accumulated in the hollow portions 24. Thus, clogging of the passages 13 of the flat heat transfer tubes 12 of the condenser 10 with the sludge can be suppressed.

Furthermore, according to Embodiment 1, the hollow portions 24 are each formed over the entire circumference of the corresponding joint 20 in the longitudinal section. However, the hollow portion 24 is not necessarily formed over the entire circumference of the joint 20. For example, the hollow portion 24 may be formed by making a hollow portion in the inside of the joint 20. Here, most of the deposited sludge precipitates in the refrigerant and is accumulated in a lower portion of the hollow portion 24. Accordingly, when the hollow portion 24 is formed by making a hollow portion in part of the inside of the joint 20, the joint 20 may be formed, for example, as follows.

Figure 7:
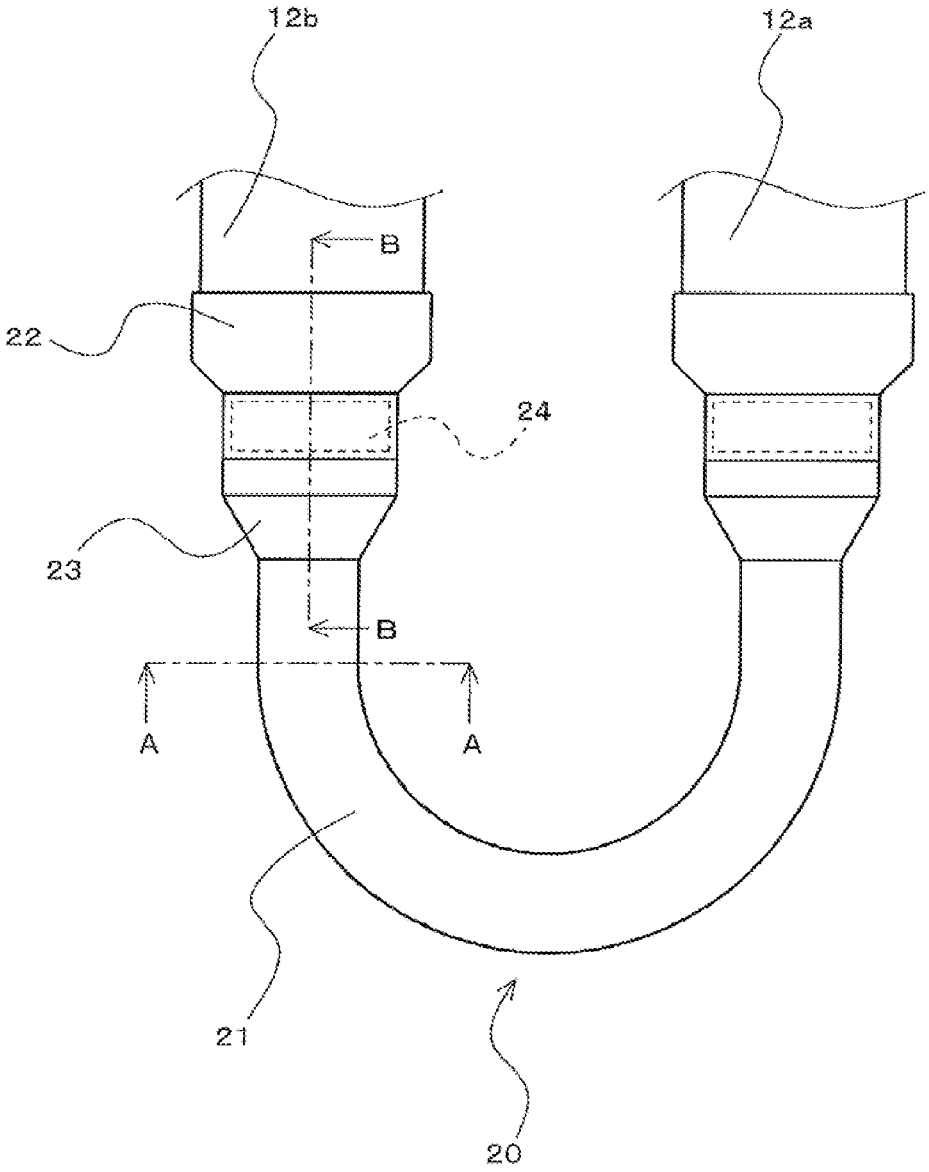
FIG. 7 is a plan view illustrating another example of the joint 20 of the condenser 10 according to Embodiment 1 of the present invention.
Figure 8:
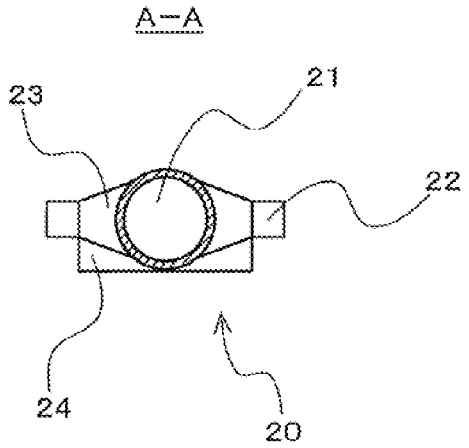
FIG. 8 is a sectional view taken along line A-A illustrated in FIG. 7.

FIG. 7 is a plan view illustrating another example of the joint 20 of the condenser 10 according to Embodiment 1 of the present invention. FIG. 8 is a sectional view taken along line A-A illustrated in FIG. 7. Furthermore, FIG. 9 is a sectional view taken along line B-B illustrated in FIG. 7.

Figure 9:
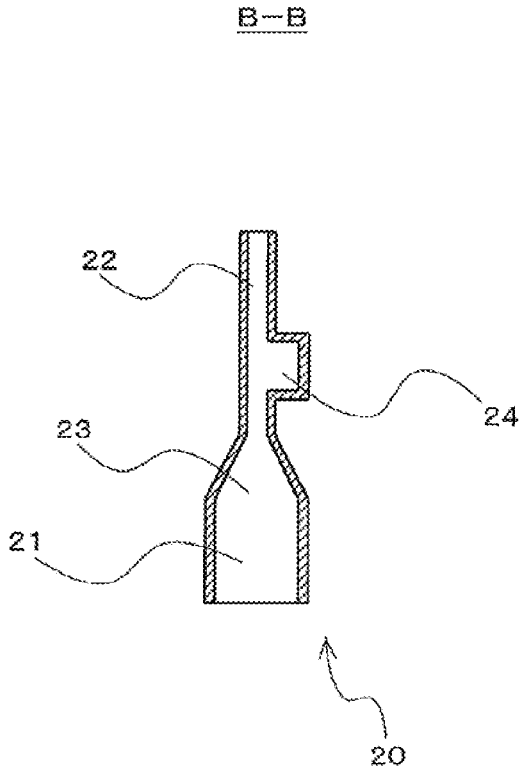
FIG. 9 is a sectional view taken along line B-B illustrated in FIG. 7.

The joint 20 illustrated in FIGS. 7 to 9 has, for example, the hollow portions 24 that are each concaved downward relative to a surrounding region in the flat portion 22. Also with the joint 20 structured as described above, the sludge can be accumulated in the hollow portion 24. Thus, clogging of the passages 13 of the flat heat transfer tubes 12 of the condenser 10 with the sludge can be suppressed.

Here, when the hollow portion 24 is formed by making a hollow portion in part of the inside of the joint 20 as illustrated in FIGS. 7 to 9, the hollow portion 24 is concaved upward relative to the surrounding region in the case where the joint 20 is mounted upside down or the condenser 10 is installed upside down. Thus, it may be feared that the sludge cannot be captured by the hollow portion 24. When there is such a fear, the joint 20 may be formed, for example, as follows.

Figure 10:
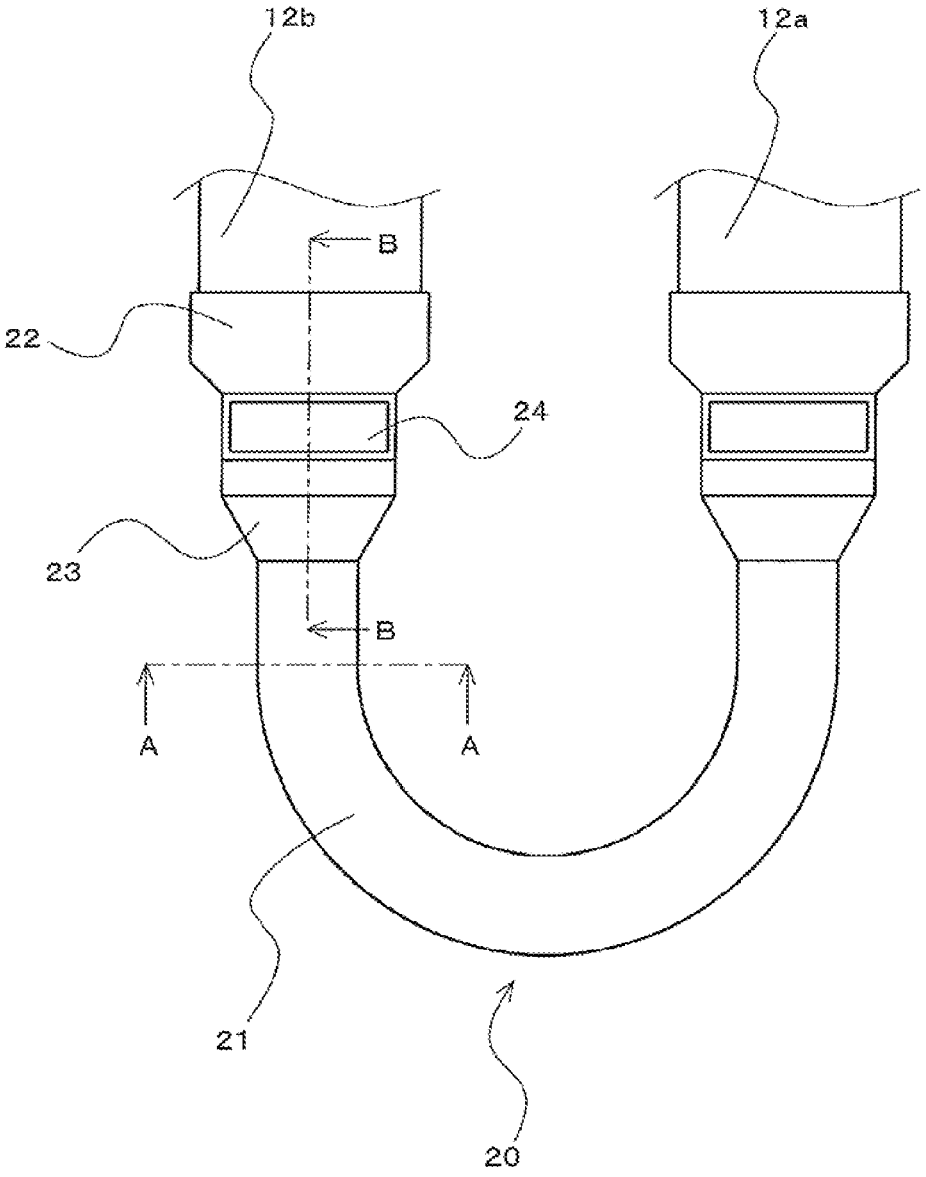
FIG. 10 is a plan view illustrating yet another example of the joint 20 of the condenser 10 according to Embodiment 1 of the present invention.
Figure 11:
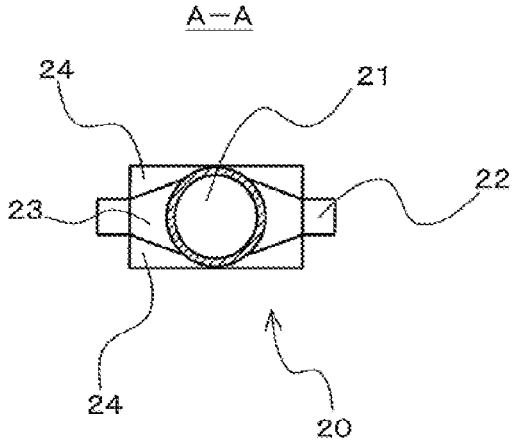
FIG. 11 is a sectional view taken along line A-A illustrated in FIG. 10.

FIG. 10 is a plan view illustrating yet another example of the joint 20 of the condenser 10 according to Embodiment 1 of the present invention. FIG. 11 is a sectional view taken along line A-A illustrated in FIG. 10. Furthermore, FIG. 12 is a sectional view taken along line B-B illustrated in FIG. 10.

Figure 12:
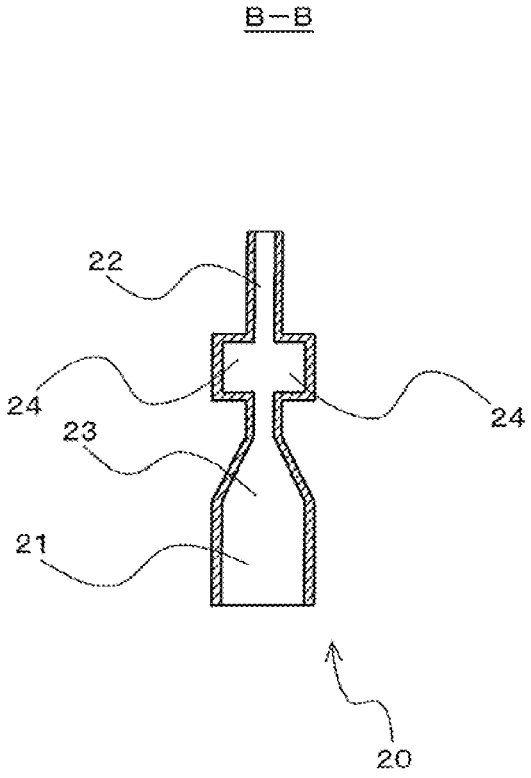
FIG. 12 is a sectional view taken along line B-B illustrated in FIG. 10.

The joint 20 illustrated in FIGS. 10 to 12 has, for example, the hollow portion 24 that is concaved downward relative to the surrounding region and the hollow portion 24 that is concaved upward relative to the surrounding region in the flat portion 22. With the joint 20 having the above-described structure, the joint 20 inevitably has the hollow portion 24 concaved downward relative to the surrounding region in the case where the joint 20 is mounted upside down or the condenser 10 is installed upside down. Accordingly, the sludge can be accumulated in the hollow portion 24 even in the case where the joint 20 is mounted upside down or the condenser 10 is installed upside down.

Furthermore, according to Embodiment 1, two flat heat transfer tubes 12 connected through the joint 20 are arranged in the horizontal direction, and the passage 11 in which the flow of the refrigerant turns in the horizontal direction is formed in the condenser 10. However, this is not limiting. Two flat heat transfer tubes 12 connected through the joint 20 may be arranged in the vertical direction, and the passage 11 in which the flow of the refrigerant turns in the vertical direction maybe formed in the condenser 10. In this case, the joint 20 is structured, for example, as illustrated in FIG. 13.

Figure 13:
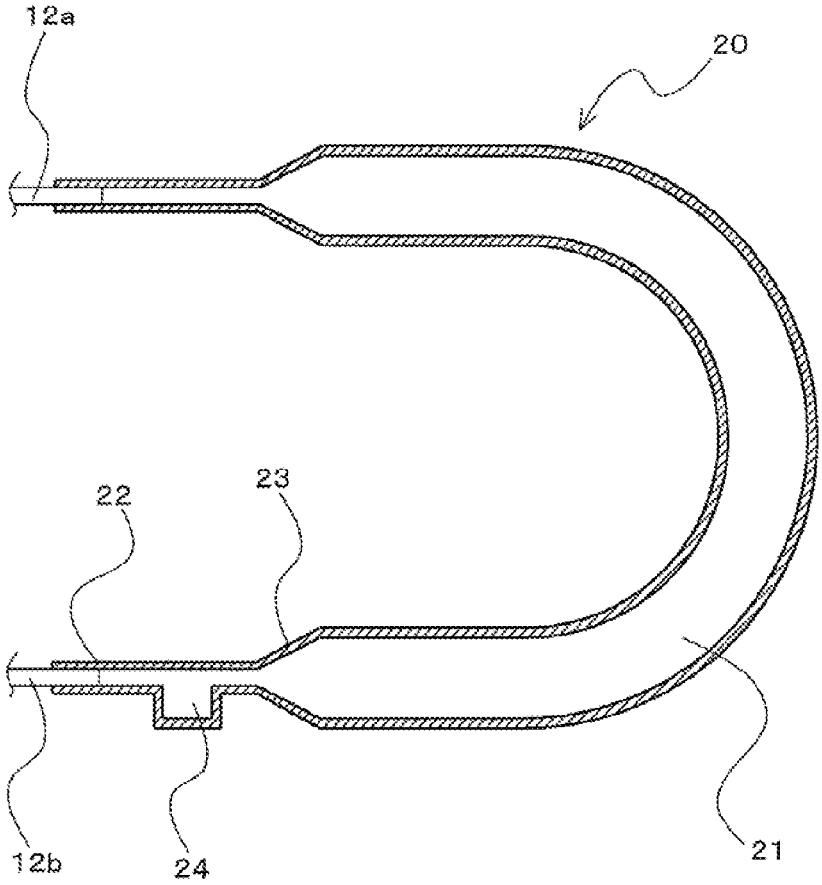
FIG. 13 is a longitudinal sectional view illustrating yet another example of the joint 20 according to Embodiment 1 of the present invention when seen from the front side.

FIG. 13 is a longitudinal sectional view illustrating yet another example of the joint 20 according to Embodiment 1 of the present invention when seen from the front side.

The joint 20 illustrated in FIG. 13 connects the flat heat transfer tubes 12 arranged in the vertical direction to each other. The hollow portion 24 that is concaved downward relative to a surrounding region is formed in a lower portion of the joint 20, for example, in the inside of the flat portion 22. Also when the passages 11 of the condenser 10 are each formed by using such a joint 20, the sludge can be accumulated in the hollow portion 24. Thus, clogging of the passages 13 of the flat heat transfer tubes 12 of the condenser 10 with the sludge can be suppressed. Either of the vertically arranged flat heat transfer tubes 12 may be the flat heat transfer tube 12*a* on the upstream side.

Here, also when the joint 20 has the structure as illustrated in FIG. 13, the hollow portion 24 is concaved upward relative to the surrounding region in the case where the joint 20 is mounted upside down or the condenser 10 is installed upside down. Thus, it may be feared that the sludge cannot be captured by the hollow portion 24. When there is such a fear, the joint 20 may be formed, for example, as follows.

Figure 14:
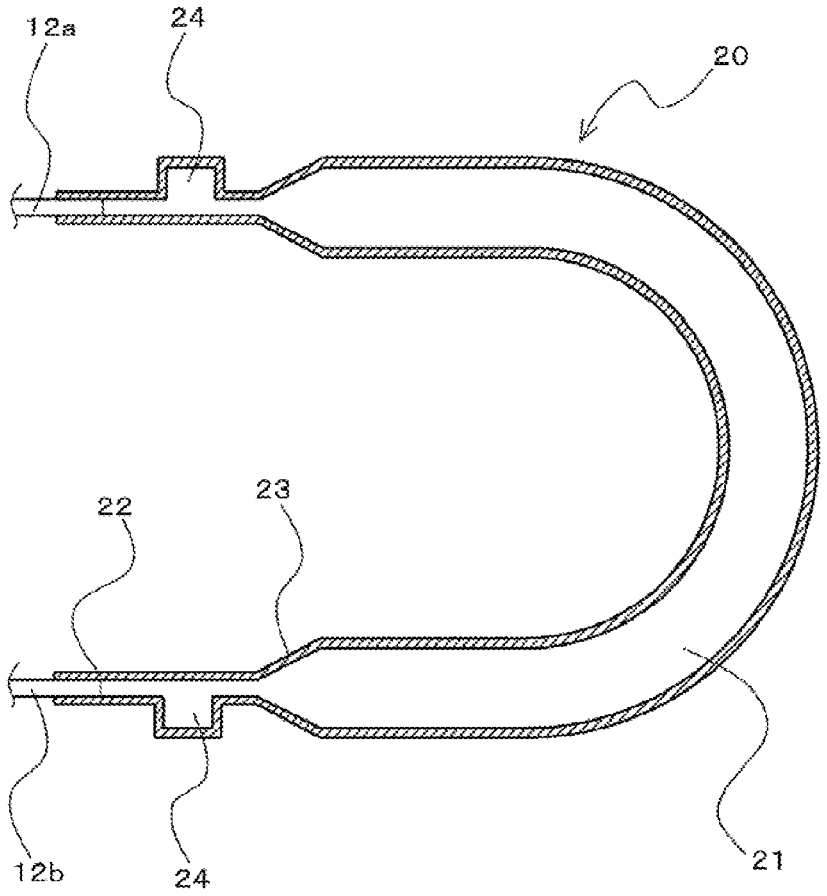
FIG. 14 is a longitudinal sectional view illustrating yet another example of the joint 20 according to Embodiment 1 of the present invention when seen from the front side.

FIG. 14 is a longitudinal sectional view illustrating yet another example of the joint 20 according to Embodiment 1 of the present invention when seen from the front side.

The joint 20 illustrated in FIG. 14 has the hollow portion 24 that is concaved downward relative to a surrounding region and is formed in a lower portion, for example, in the inside of the flat portion 22. The joint 20 illustrated in FIG. 14 also has the hollow portion 24 that is concaved upward relative to a surrounding region and is formed in an upper portion, for example, in the inside of the flat portion 22. With the joint 20 having the above-described structure, the joint 20 inevitably has the hollow portion 24 concaved downward relative to the surrounding region in the case where the joint 20 is mounted upside down or the condenser 10 is installed upside down. Accordingly, the sludge can be accumulated in the hollow portion 24 even in the case where the joint 20 is mounted upside down or the condenser 10 is installed upside down.

Of course, when connecting the vertically arranged flat heat transfer tubes 12 to each other through the joint 20, the hollow portions 24 may be formed over the entire circumference of the joint 20 as illustrated in FIGS. 4 and 5.

Furthermore, in each of the passages 11 of the condenser 10 according to Embodiment 1, the flow of the refrigerant turns only once. However, this is not limiting. The passage 11 may have a structure in which the flow of the refrigerant turns a plurality of times.

Figure 15:
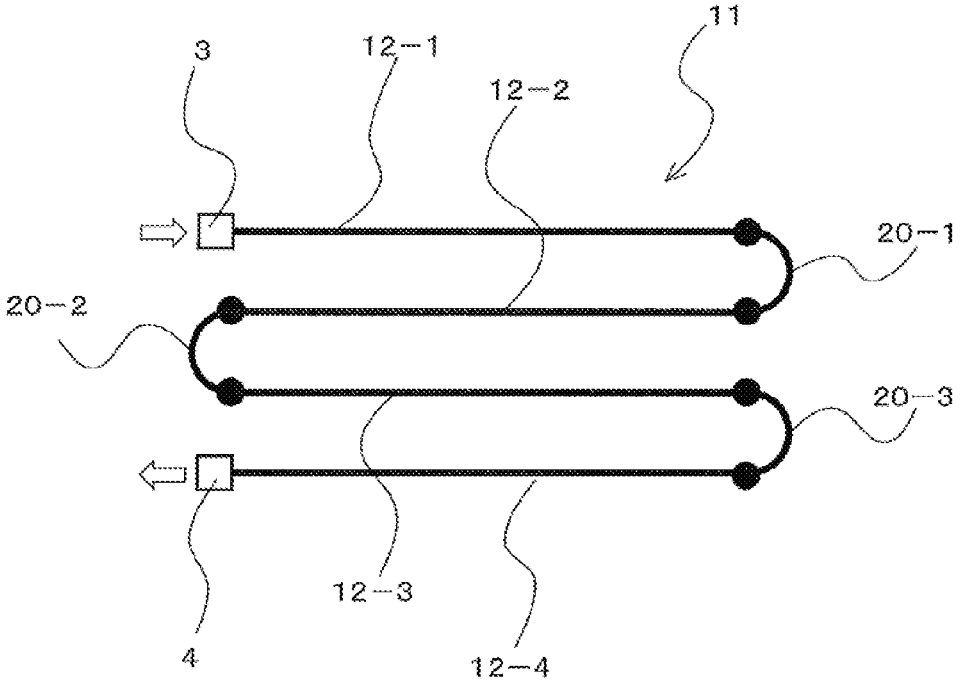
FIG. 15 is a schematic view illustrating another example of the passage 11 of the condenser 10 according to Embodiment 1.
Figure 16:
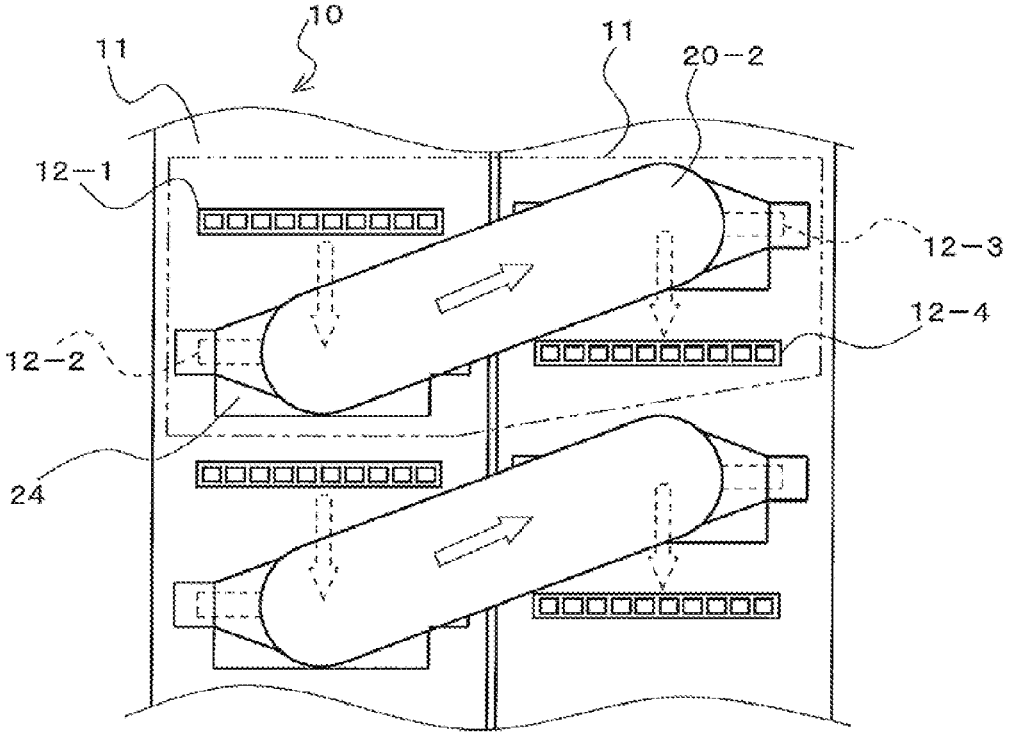
FIG. 16 is an enlarged view of a main portion of the condenser 10 for which the passage 11 illustrated in FIG. 15 is used when seen from a side-surface side.

FIG. 15 is a schematic view illustrating another example of the passage 11 of the condenser 10 according to Embodiment 1. FIG. 16 is an enlarged view of a main portion of the condenser 10 for which the passage 11 illustrated in FIG. 15 is used when seen from a side-surface side. White arrows illustrated in FIGS. 15 and 16 indicate the refrigerant flowing direction. Furthermore, in FIG. 16, two passages 11 are illustrated.

The passages 11 of the condenser 10 illustrated in FIGS. 15 and 16 are each formed by serially connecting four flat heat transfer tubes 12 with three joints 20. For convenience of description, four flat heat transfer tubes 12 are referred to as flat heat transfer tubes 12-1, 12-2, 12-3, and 12-4 in this order in the refrigerant flowing direction, that is, in a direction from the gas header 3 toward the liquid header 4. Furthermore, three joints 20 are referred to as joints 20-1, 20-2, and 20-3 in this order in the refrigerant flowing direction, that is, in a direction from the gas header 3 toward the liquid header 4.

As described above, the sludge is likely to be deposited in a range from a position near the central portion of the passage 11 toward a position on the downstream side of the passage 11. Accordingly, for example, as illustrated in FIG. 16, when the hollow portion 24 is disposed in the joint 20-2 disposed at the central portion of the passage 11, the sludge can be accumulated in this hollow portion 24. Thus, clogging of the passages 13 of the flat heat transfer tubes 12 of the condenser 10 with the sludge can be suppressed. In this case, the flat heat transfer tube 12-1, the joint 20-1, and the flat heat transfer tube 12-2 correspond to the first passage of the present invention. The flat heat transfer tube 12-2 connected to the joint 20-2 corresponds to the first flat heat transfer tube of the present invention. Furthermore, the flat heat transfer tube 12-3, the joint 20-3, and the flat heat transfer tube 12-4 correspond to the second passage of the present invention. Furthermore, the flat heat transfer tube 12-3 connected to the joint 20-2 corresponds to the second flat heat transfer tube of the present invention.

Furthermore, for example, in each of the passages 11 illustrated in FIGS. 15 and 16, the joint 20-3, which is disposed at a position where the length of part of the passage 11 is ¾ of the total length of the passage 11 in the refrigerant flowing direction, has a structure that is, for example, the structure illustrated in FIG. 13, and the hollow portion 24 is formed in this joint 20-3. The sludge can be accumulated in this hollow portion 24. Thus, clogging of the passages 13 of the flat heat transfer tubes 12 of the condenser 10 with the sludge can be suppressed. In this case, the flat heat transfer tube 12-1, the joint 20-1, the flat heat transfer tube 12-2, the joint 20-2, and the flat heat transfer tube 12-3 correspond to the first passage of the present invention. Furthermore, the flat heat transfer tube 12-3 connected to the joint 20-3 corresponds to the first flat heat transfer tube of the present invention. Furthermore, the flat heat transfer tube 12-4 corresponds to the second passage and the second flat heat transfer tube of the present invention. That is, it is sufficient that the hollow portion 24 be formed in the joint 20 disposed at a position from which the length of the second passage is equal to or smaller than the length of the first passage.

Embodiment 2

In the case where each of the joints 20 is separately formed as is the case with Embodiment 1, assembling man-hours of the condenser 10 may increase due to, for example, an increase in man-hour for brazing the joints 20 and the flat heat transfer tubes 12 to one another, depending on the number of the joints 20. In such a case, a plurality of the joints 20 may be formed as a single joint unit. The joints 20 that can be included in the joint unit will be described in Embodiments below. Of course, the joints 20 described in Embodiments below may be separately fabricated instead of being fabricated as part of the unit. Furthermore, in Embodiments below, items not particularly described are similar to those of Embodiment 1, and the same functions and the same structures are denoted by the same reference signs.

Figure 17:
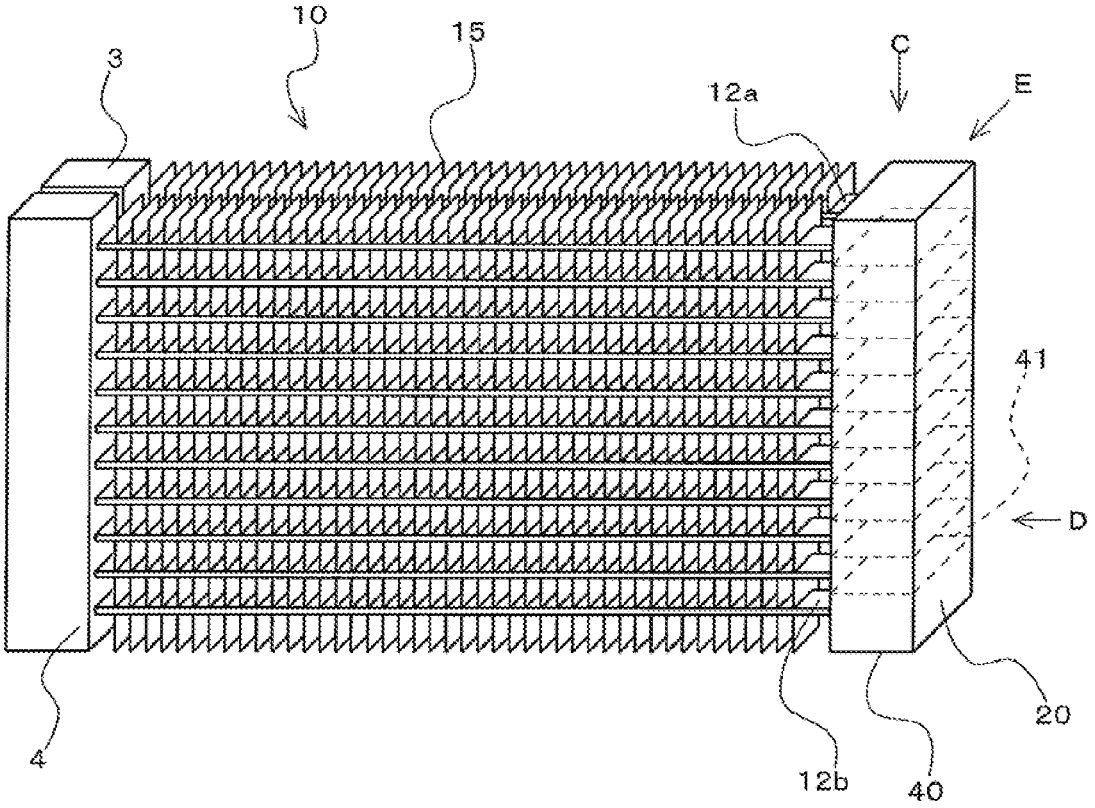
FIG. 17 is a perspective view illustrating the condenser 10, the gas header 3, and the liquid header 4 according to Embodiment 2 of the present invention.

FIG. 17 is a perspective view illustrating the condenser 10, the gas header 3, and the liquid header 4 according to Embodiment 2 of the present invention.

The condenser 10 according to Embodiment 2 includes a hollow joint unit 40 having, for example, a rectangular parallelepiped shape. The inside of the joint unit 40 is separated into a plurality of spaces by separating walls 41. That is, in the joint unit 40, a plurality of joints 20 having respective chambers to which the flat heat transfer tubes 12 are connected are arranged in the up-down direction. According to Embodiment 2, each of the joints 20 is structured as follows.

Figure 18:
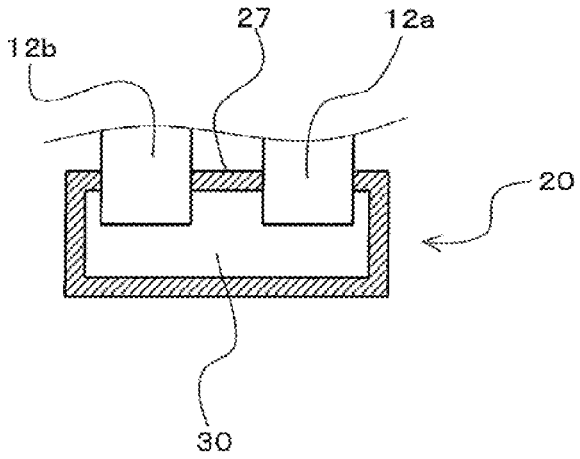
FIG. 18 includes enlarged views of a main portion of the joint 20 portion of the condenser 10 according to Embodiment 2 of the present invention.
Figure 18:
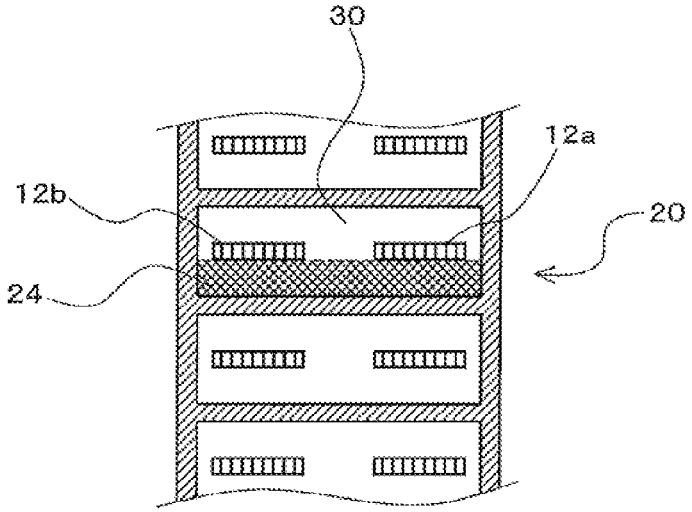

FIG. 18 includes enlarged views of a main portion of the joint 20 portion of the condenser 10 according to Embodiment 2 of the present invention. FIG. 18(A) is a sectional view when the joint 20 portion is seen in a C direction illustrated in FIG. 17, that is, a sectional plan view. FIG. 18(B) is a sectional view when the joint 20 portion is seen in a D direction illustrated in FIG. 17, that is, a longitudinal sectional side view.

As illustrated in FIG. 18, the joints 20 according to Embodiment 2 each have, for example, a rectangular parallelepiped shape having a hollow therein. The flat heat transfer tubes 12*a* and 12*b* included in the same passage 11 are mounted to the joint 20 so as to penetrate through a side surface 27 of the joint 20, that is, communicate with an inner space of the joint 20. That is, the inner space and walls surrounding the inner space of the joint 20 form a chamber 30 to which the flat heat transfer tubes 12*a* and 12*b* included in the same passage 11 are connected. According to Embodiment 2, the flat heat transfer tubes 12*a* and 12*b* included in the same passage 11 are arranged in the horizontal direction and connected to the side surface 27. In the joint 20 structured as described above, a portion below the flat heat transfer tubes 12*a* and 12*b*, that is, a shaded portion in FIG. 18 serves as the hollow portion 24.

Next, the flow of the refrigerant in the joint 20 according to Embodiment 2 is described.

The refrigerant flowing from the flat heat transfer tube 12*a* into the chamber 30 of the joint 20 is retained once in the chamber 30, and then, flows into the flat heat transfer tube 12*b*. While the refrigerant is being retained in the chamber 30, the deposited sludge is accumulated in the hollow portion 24.

Thus, with the joint 20 according to Embodiment 2, the sludge can be accumulated in the hollow portion 24. Thus, clogging of the passages 13 of the flat heat transfer tubes 12 of the condenser 10 with the sludge can be suppressed.

Embodiment 3

Figure 19:
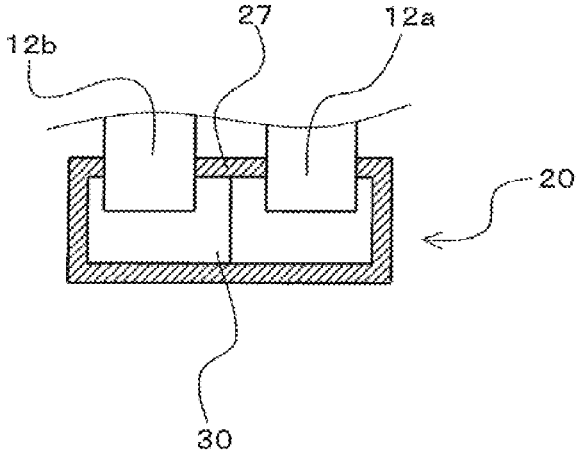
FIG. 19 includes enlarged views of a main portion of the joint 20 portion of the condenser 10 according to Embodiment 3 of the present invention.
Figure 19:
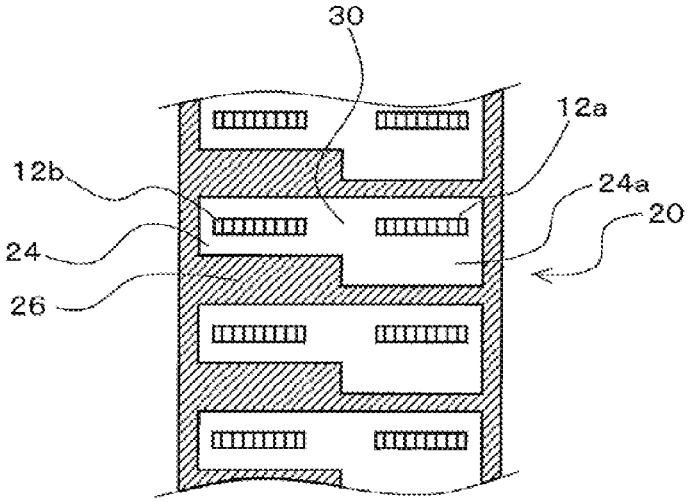

FIG. 19 includes enlarged views of a main portion of the joint 20 portion of the condenser 10 according to Embodiment 3 of the present invention. FIG. 19(A) is a sectional view of one of the joints 20 when the condenser 10 according to Embodiment 3 of the present invention is seen in the C direction illustrated in FIG. 17, that is, a sectional plan view. FIG. 19(B) is a sectional view of the joints 20 when the condenser 10 according to Embodiment 3 of the present invention is seen in the D direction illustrated in FIG. 17, that is, a longitudinal sectional side view.

The basic structure of each of the joints 20 according to Embodiment 3 is similar to that of the joint 20 described in Embodiment 2. The difference between the joint 20 according to Embodiment 3 and the joint 20 described in Embodiment 2 is the shape of a lower surface 26 of the chamber 30. Particularly, the joint 20 according to Embodiment 3 has a second hollow portion 24*a* in a region of the lower surface 26 of the chamber 30 facing the flat heat transfer tube 12*a*. The second hollow portion 24*a* is concaved downward relative to a region of the lower surface 26 of the chamber 30 facing the flat heat transfer tube 12*b*.

Also with the joint 20 structured as in Embodiment 3, the sludge can be accumulated in the hollow portion 24 and the second hollow portion 24*a*. Thus, clogging of the passages 13 of the flat heat transfer tubes 12 of the condenser 10 with the sludge can be suppressed. Furthermore, with the joint 20 structured as in Embodiment 3, the following effect can also be obtained. That is, the refrigerant flowing through the chamber 30 of the joint 20 flows from the flat heat transfer tube 12*a* and flows into the flat heat transfer tube 12*b*. That is, the refrigerant flowing direction in the chamber 30 is a horizontal direction. Accordingly, in the second hollow portion 24*a* that is concaved downward relative to the region of the lower surface 26 of the chamber 30 facing the flat heat transfer tube 12*b*, the sludge accumulated in the second hollow portion 24*a* can be prevented from being pulled upward and being caused to flow toward the downstream side. Thus, clogging of the passages 13 of the flat heat transfer tubes 12 of the condenser 10 with the sludge can be further suppressed.

Embodiment 4

Figure 20:
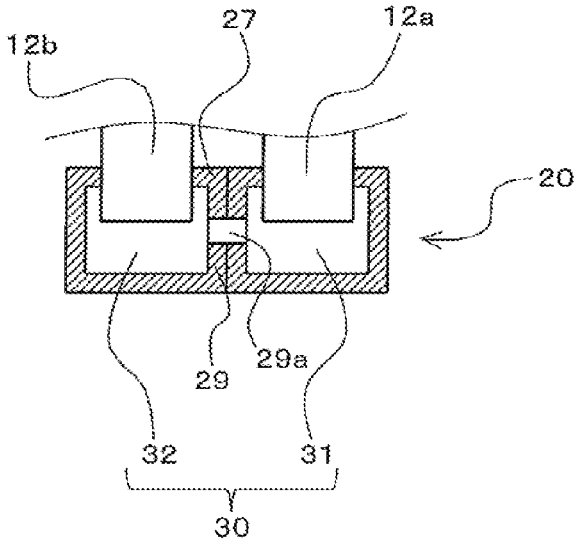
FIG. 20 includes enlarged views of a main portion of the joint 20 portion of the condenser 10 according to Embodiment 4 of the present invention.
Figure 20:
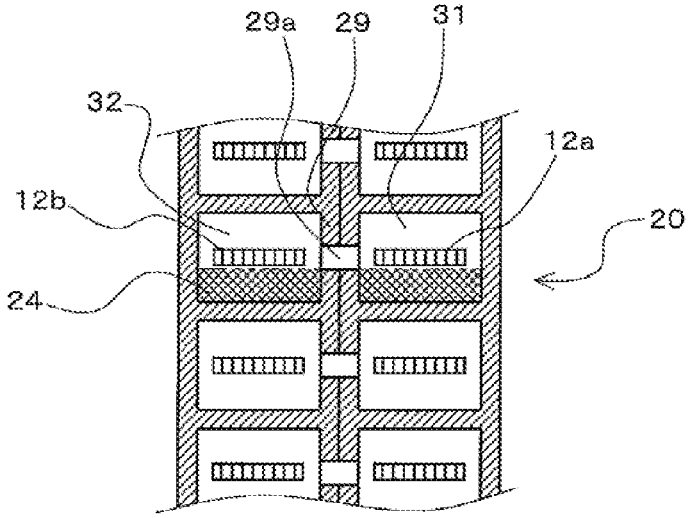

FIG. 20 includes enlarged views of a main portion of the joint 20 portion of the condenser 10 according to Embodiment 4 of the present invention. FIG. 20(A) is a sectional view of one of the joints 20 when the condenser 10 according to Embodiment 4 of the present invention is seen in the C direction illustrated in FIG. 17, that is, a sectional plan view. FIG. 20(B) is a sectional view of the joints 20 when the condenser 10 according to Embodiment 4 of the present invention is seen in the D direction illustrated in FIG. 17, that is, a longitudinal sectional side view.

The basic structure of each of the joints 20 according to Embodiment 4 is similar to that of the joint 20 described in Embodiment 2. The difference between the joint 20 according to Embodiment 4 and the joint 20 described in Embodiment 2 is that the chamber 30 is separated by a separating wall 29 according to Embodiment 4. For example, when it is wished, for example, to improve the pressure resistance of the joint 20, the separating wall 29 is provided. Particularly, the separating wall 29 separates the chamber 30 of the joint 20 into a chamber 31 to which the flat heat transfer tube 12*a* is connected and a chamber 32 to which the flat heat transfer tube 12*b* is connected. Furthermore, a passage 29*a* that penetrates through the separating wall 29 is provided in the separating wall 29. In the joint 20 structured as described above, portions below the passage 29*a* in the chamber 31 and the chamber 32, that is, shaded portions in FIG. 20 serve as the hollow portion 24.

Here, the chamber 31 corresponds to a first chamber of the present invention. The chamber 32 corresponds to a second chamber of the present invention. Furthermore, the passage 29*a* corresponds to a third passage of the present invention.

Also with the joint 20 structured as in Embodiment 4, the sludge can be accumulated in the hollow portion 24. Thus, clogging of the passages 13 of the flat heat transfer tubes 12 of the condenser 10 with the sludge can be suppressed. Furthermore, with the joint 20 structured as in Embodiment 4, the following effect can also be obtained. That is, since the refrigerant flowing from the chamber 31 to the chamber 32 passes through the passage 29*a*, the likelihood of the refrigerant being retained in the hollow portion 24 formed below the passage 29*a* is increased. Accordingly, the sludge accumulated in the hollow portion 24 can be prevented from being pulled upward. Thus, clogging of the passages 13 of the flat heat transfer tubes 12 of the condenser 10 with the sludge can be further suppressed.

In the case where the joint 20 is structured as in Embodiment 4, the passage 29*a* may be disposed at a position as follows.

Figure 21:
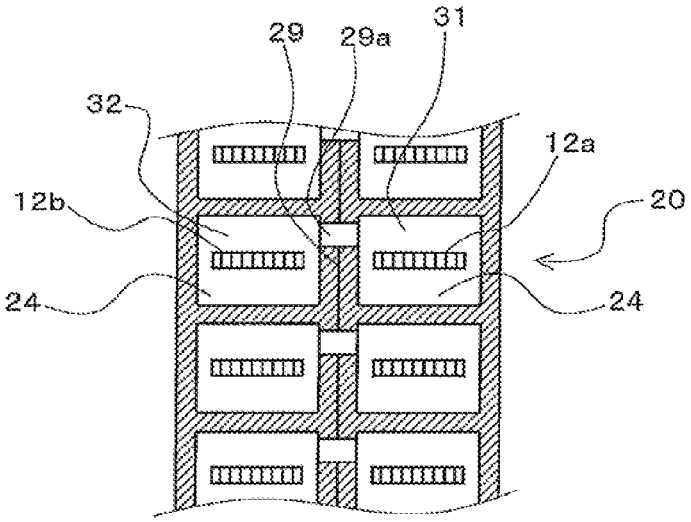
FIG. 21 is an enlarged view of a main portion of another example of the joint 20 according to Embodiment 4 of the present invention.

FIG. 21 is an enlarged view of a main portion of another example of the joint 20 according to Embodiment 4 of the present invention.

The passage 29*a* of each of the joints 20 illustrated in FIG. 21 is disposed at a higher position than the flat heat transfer tube 12*a*. With the joint 20 structured as described above, since the levels of the passage 29*a* and the flat heat transfer tube 12*a* are different from each other, the refrigerant flowing from the flat heat transfer tube 12*a* to the chamber 31 cannot directly flow into the passage 29*a*. Accordingly, the refrigerant flowing from the flat heat transfer tube 12*a* to the chamber 31 is retained once in the chamber 31, and then, flows into the chamber 32. This reduces the likelihood of the sludge flowing into the chamber 32. Thus, since flowing of the sludge accumulated in the chamber 32 into the flat heat transfer tube 12*b* can be suppressed, clogging of the passages 13 of the flat heat transfer tubes 12 of the condenser 10 with the sludge can be further suppressed.

Here, persons skilled in the art typically think of minimizing the retention of the refrigerant in the refrigeration cycle circuit to increase the amount of the refrigerant circulating through the refrigeration cycle circuit as much as possible. Accordingly, in the case of fabricating a condenser of a refrigeration cycle circuit for which a refrigerant that produces small amount of sludge is used, the persons skilled in the art may coincidentally conceive the joint 20 as that in Embodiment 4. It should be added that, even in this case, the persons skilled in the art cannot conceive the structure in which the passage 29*a* is disposed at a higher position than the flat heat transfer tube 12*a*.

Embodiment 5

Figure 22:
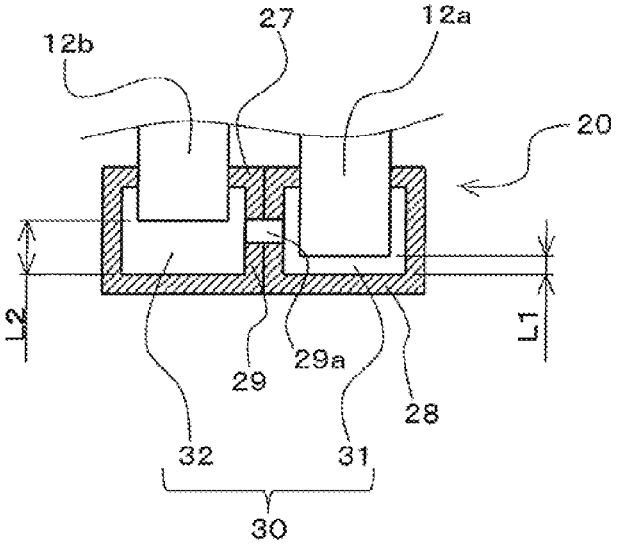
FIG. 22 is an enlarged view of a main portion of the joint 20 portion of the condenser 10 according to Embodiment 5 of the present invention.

FIG. 22 is an enlarged view of a main portion of the joint 20 portion of the condenser 10 according to Embodiment 5 of the present invention. This FIG. 22 is a sectional view of the joint 20 when the condenser 10 according to Embodiment 5 of the present invention is seen in the C direction illustrated in FIG. 17, that is, a sectional plan view.

The basic structure of the joint 20 according to Embodiment 5 is similar to the joint 20 described in any one of Embodiments 2 to 4. The difference between the joint 20 according to Embodiment 5 and the joint 20 described in any one of Embodiments 2 to 4 is the position of the end portion of the flat heat transfer tube 12*a* in the joint 20. FIG. 22 illustrates the joint 20 according to Embodiment 5 in the example of the joint 20 illustrated in Embodiment 4.

Particularly, in the joint 20 according to Embodiment 5, the end portion of at least the flat heat transfer tube 12*a* projects into the chamber 30 of the joint 20. Furthermore, a distance L1 between the end portion of the flat heat transfer tube 12*a* on the side of the flat heat transfer tube 12*a* connected to the chamber 30 and a side surface 28 of the chamber 30 facing this end portion is smaller than a distance L2 between the end portion of the flat heat transfer tube 12*b* on the side of the flat heat transfer tube 12*b* connected to the chamber 30 and the side surface 28 of the chamber 30 facing this end portion.

When the end portion of the flat heat transfer tube 12*a* is disposed near the side surface 28 of the chamber 30, the sludge flowing from the flat heat transfer tube 12*a* into the chamber 30 together with the refrigerant collides with the side surface 28. The sludge having collided with the side surface 28 directly drops into the hollow portion 24 and is accumulated in the hollow portion 24. Thus, with the joint 20 structured as in Embodiment 5, more sludge can be captured. Accordingly, clogging of the passages 13 of the flat heat transfer tubes 12 of the condenser 10 with the sludge can be further suppressed.

When using the joint 20 according to Embodiment 5, it is preferable that refrigerating machine oil to which an epoxy compound is added be charged into the refrigeration cycle circuit 1. An epoxy compound has a good adhesive property and is used as a material of adhesives. Accordingly, the sludge produced by reaction with the epoxy compound is attracted onto the side surface 28 of the chamber 30 when the sludge collides with the side surface 28 by charging the refrigerating machine oil to which an epoxy compound is added into the refrigeration cycle circuit 1. Accordingly, since flowing of the sludge captured once in the chamber 30 toward the downstream side can be suppressed, clogging of the passages 13 of the flat heat transfer tubes 12 of the condenser 10 with the sludge can be further suppressed.

Furthermore, in the case where the end portion of the flat heat transfer tube 12*a* projects into the chamber 30 of the joint 20 the basic structure of which is that of the joint 20 described in Embodiment 5, it is preferable that the position of the passage 29*a* relative to the flat heat transfer tube 12*a* be the position illustrated in FIG. 22. That is, it is preferable that the passage 29*a* be closer to the side surface 27 of the chamber 30 to which the flat heat transfer tube 12*a* is connected than the end portion of the flat heat transfer tube 12*a* on the side projecting into the chamber 31. With the joint 20 structured as described above, the refrigerant flowing from the flat heat transfer tube 12*a* to the chamber 31 cannot directly flow into the passage 29*a*. Accordingly, the refrigerant flowing from the flat heat transfer tube 12*a* to the chamber 31 is retained once in the chamber 31, and then, flows into the chamber 32. This reduces the likelihood of the sludge flowing into the chamber 32. Thus, since flowing of the sludge accumulated in the chamber 32 into the flat heat transfer tube 12*b* can be suppressed, clogging of the passages 13 of the flat heat transfer tubes 12 of the condenser 10 with the sludge can be further suppressed. This effect can be obtained even in the case where L1=L2 as long as the end portion of the flat heat transfer tube 12*a* projects into the chamber 30 of the joint 20.

Embodiment 6

Figure 23:
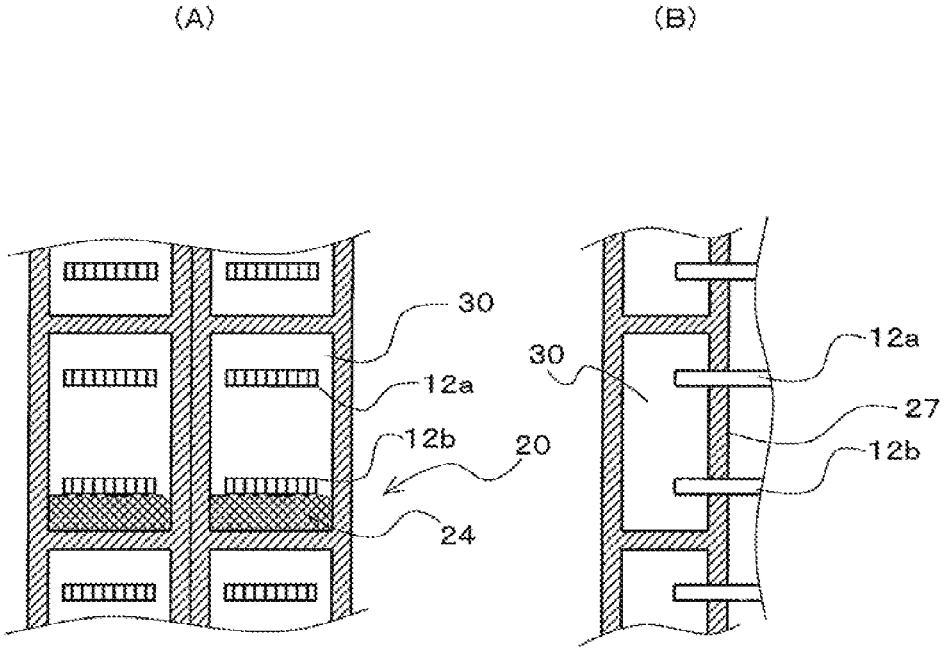
FIG. 23 includes enlarged views of a main portion of the joint 20 portion of the condenser 10 according to Embodiment 6 of the present invention.

FIG. 23 includes enlarged views of a main portion of the joint 20 portion of the condenser 10 according to Embodiment 6 of the present invention. FIG. 23(A) is a sectional view of the joints 20 when the condenser 10 according to Embodiment 6 of the present invention is seen in the D direction illustrated in FIG. 17, that is, a longitudinal sectional side view. FIG. 23(B) is a sectional view of the joints 20 when the condenser 10 according to Embodiment 6 of the present invention is seen in the E direction illustrated in FIG. 17, that is, a longitudinal sectional rear view.

As has been described with reference to, for example, FIG. 13 of Embodiment 1, in each of the passages 11, the flat heat transfer tubes 12 that form the same passage 11 may be arranged in the vertical direction to turn the flow of the refrigerant in the vertical direction in a corresponding one of the joints 20. In the condenser 10 having such passages 11, when the joints 20 are included in a single joint unit, the joints 20 can be structured as in Embodiment 6.

As illustrated in FIG. 23, the joints 20 according to Embodiment 6 each have, for example, a rectangular parallelepiped shape having a hollow therein. The flat heat transfer tubes 12*a* and 12*b* included in the same passage 11 are mounted to the joint 20 so as to penetrate through the side surface 27 of the joint 20, that is, communicate with an inner space of the joint 20. That is, the inner space and walls surrounding the inner space of the joint 20 form the chamber 30 to which the flat heat transfer tubes 12*a* and 12*b* included in the same passage 11 are connected. According to Embodiment 6, the flat heat transfer tubes 12*a* and 12*b* included in the same passage 11 are arranged in the vertical direction and connected to the side surface 27. In FIG. 23, the flat heat transfer tube 12*a* is disposed above the flat heat transfer tube 12*b*.

In each of the joints 20 structured as described above, a portion below the flat heat transfer tube 12*b*, that is, a shaded portion in FIG. 23 serves as the hollow portion 24.

With the joint 20 structured as described above, the sludge flowing from the flat heat transfer tube 12*a* into the chamber 30 of the joint 20 together with the refrigerant is accumulated in the hollow portion 24. Accordingly, the sludge can be accumulated in this hollow portion 24. Thus, clogging of the passages 13 of the flat heat transfer tubes 12 of the condenser 10 with the sludge can be suppressed.

Figure 24:
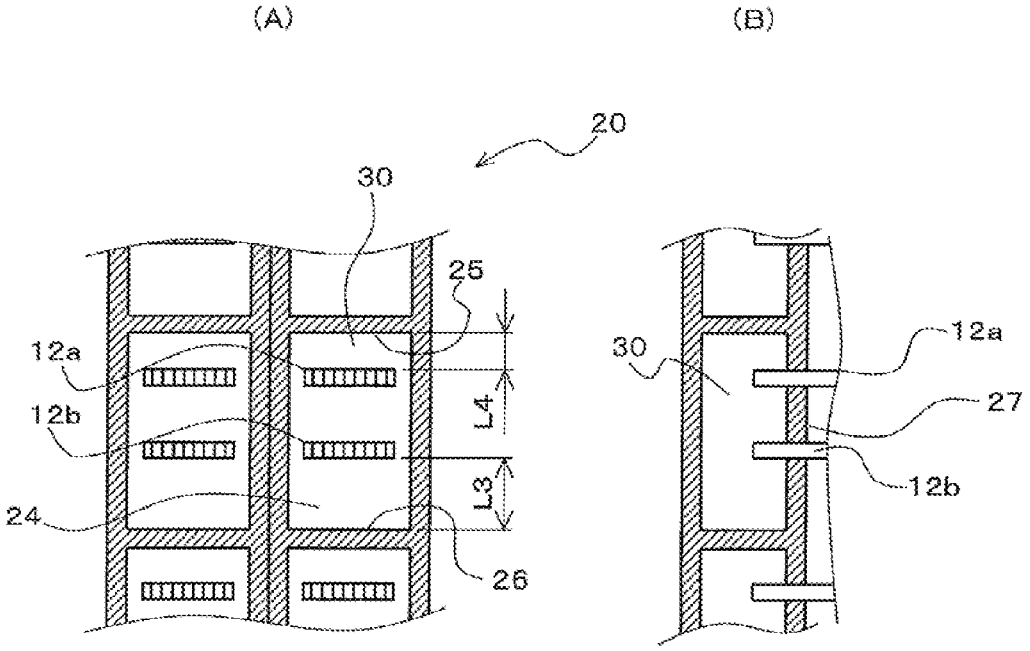
FIG. 24 includes enlarged views of a main portion of another example of the joint 20 according to Embodiment 6 of the present invention.

When the joint 20 is structured as in Embodiment 6, it is preferable that the positions of the flat heat transfer tubes 12*a* and 12*b* in the up-down direction be as follows. FIG. 24 includes enlarged views of a main portion of another example of the joint 20 according to Embodiment 6 of the present invention.

In the joint 20 illustrated in FIG. 24, a distance L3 between a lower surface of the flat heat transfer tube 12*b* and the lower surface 26 of the chamber 30 is larger than a distance L4 between an upper surface of the flat heat transfer tube 12*a* and an upper surface 25 of the chamber 30. With such a structure, the size of the hollow portion 24 can be increased, that is, more sludge can be accumulated in the hollow portion 24. Thus, clogging of the passages 13 of the flat heat transfer tubes 12 of the condenser 10 with the sludge can be further suppressed.

Here, as has been described, persons skilled in the art typically think of minimizing the retention of the refrigerant in the refrigeration cycle circuit to increase the amount of the refrigerant circulating through the refrigeration cycle circuit as much as possible. Accordingly, in the case of fabricating a condenser of a refrigeration cycle circuit for which a refrigerant that produces small amount of sludge is used, the persons skilled in the art may coincidentally conceive the joint 20 as that in Embodiment 6. Even in this case, the persons skilled in the art are likely to dispose the lower flat heat transfer tube 12*b* at a position close to the lower surface 26 of the chamber 30. In another case, even when the persons skilled in the art consider prevention of mistakes in mounting of the joint 20, it is likely that the above-described L3 and L4 are set to be equal to each other to allow an upside-down joint 20 to be successfully mounted. That is, it should be added that the persons skilled in the art cannot conceive the above-described structure in which L3 is larger than L4.

Embodiment 7

Figure 25:
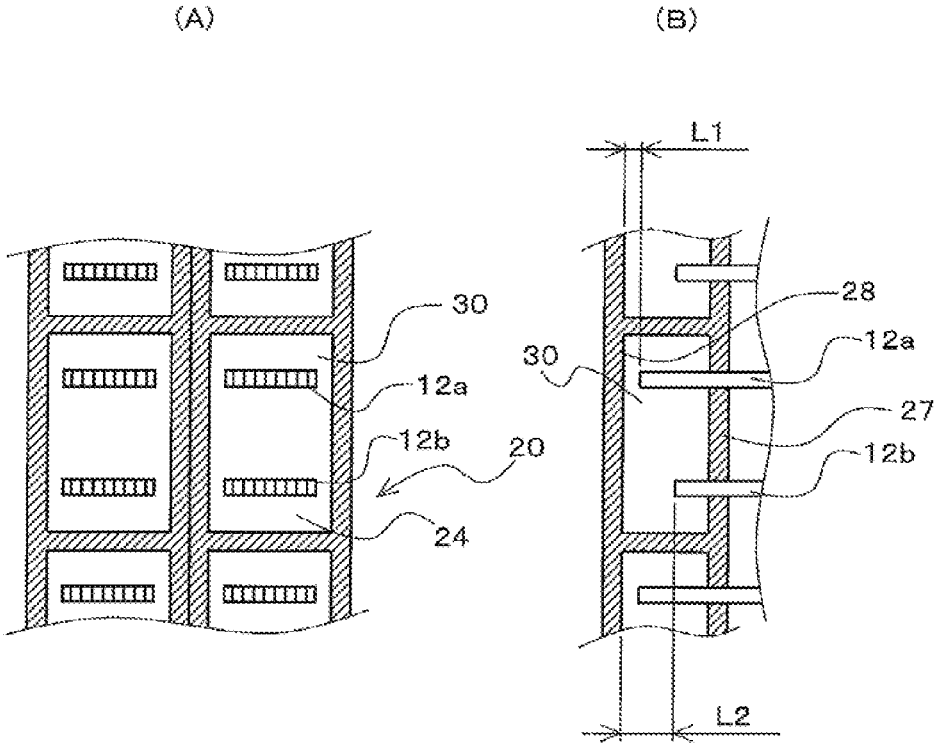
FIG. 25 is an enlarged view of a main portion of the joint 20 portion of the condenser 10 according to Embodiment 7 of the present invention.

FIG. 25 includes enlarged views of a main portion of the joint 20 portion of the condenser 10 according to Embodiment 7 of the present invention. FIG. 25(A) is a sectional view of the joints 20 when the condenser 10 according to Embodiment 7 of the present invention is seen in the D direction illustrated in FIG. 17, that is, a longitudinal sectional side view. FIG. 25(B) is a sectional view of the joints 20 when the condenser 10 according to Embodiment 7 of the present invention is seen in the E direction illustrated in FIG. 17, that is, a longitudinal sectional rear view.

The basic structure of each of the joints 20 according to Embodiment 7 is similar to that of the joint 20 described in Embodiment 6. The difference between the joint 20 according to Embodiment 7 and the joint 20 described in Embodiment 6 is the position of the end portion of the flat heat transfer tube 12*a* in the joint 20.

Particularly, in the joint 20 according to Embodiment 7, the end portion of at least the flat heat transfer tube 12*a* projects into the chamber 30 of the joint 20. Furthermore, a distance L1 between the end portion of the flat heat transfer tube 12*a* on the side of the flat heat transfer tube 12*a* connected to the chamber 30 and the side surface 28 of the chamber 30 facing this end portion is smaller than the distance L2 between the end portion of the flat heat transfer tube 12*b* on the side of the flat heat transfer tube 12*b* connected to the chamber 30 and the side surface 28 of the chamber 30 facing this end portion.

When the end portion of the flat heat transfer tube 12*a* is disposed near the side surface 28 of the chamber 30, the sludge flowing from the flat heat transfer tube 12*a* into the chamber 30 together with the refrigerant collides with the side surface 28. The sludge having collided with the side surface 28 directly drops into the hollow portion 24 and is accumulated in the hollow portion 24. Thus, with the joint 20 structured as in Embodiment 7, more sludge can be captured. Accordingly, clogging of the passages 13 of the flat heat transfer tubes 12 of the condenser 10 with the sludge can be further suppressed.

When using the joint 20 according to Embodiment 7, it is preferable that refrigerating machine oil to which an epoxy compound is added be charged into the refrigeration cycle circuit 1. An epoxy compound has a good adhesive property and is used as a material of adhesives. Accordingly, the sludge produced by a reaction with the epoxy compound is attracted onto the side surface 28 of the chamber 30 when the sludge collides with the side surface 28 by charging the refrigerating machine oil to which an epoxy compound is added into the refrigeration cycle circuit 1. Accordingly, since flowing of the sludge captured once in the chamber 30 toward the downstream side can be suppressed, clogging of the passages 13 of the flat heat transfer tubes 12 of the condenser 10 with the sludge can be further suppressed.

REFERENCE SIGNS LIST

1 refrigeration cycle circuit 2 compressor 3 gas header 4 liquid header 5 expansion device 6 evaporator 10 condenser 11 passage 12 (12*a*, 12*b*) flat heat transfer tube 13 passage 15 fin 20 joint 21 circular tube portion 22 flat portion 23 shape-changing portion 24 hollow portion 24*a* second hollow portion 25 upper surface 26 lower surface 27 side surface 28 side surface 29 separating wall 29*a* passage 30 chamber 31 chamber 32 chamber 40 joint unit 41 separating wall 100 refrigeration cycle apparatus.

The invention claimed is:

1. A refrigeration cycle apparatus comprising:

a refrigeration cycle circuit including a compressor, a condenser, and an expansion device; and hydrofluoroolefin-based refrigerant charged into the refrigeration cycle circuit, the condenser including:

a first passage connecting to the compressor at a first end and constituted of, at a second end, a first flat heat transfer tube including a plurality of passages thereof, a second passage connecting to the expansion device at a first end and constituted of, at a second end, a second flat heat transfer tube including a plurality of passages thereof, and a joint having a rectangular parallelepiped shape joining the first flat heat transfer tube and the second flat heat transfer tube, bending a flow of the hydrofluoroolefin-based refrigerant between the first flat heat transfer tube and the second flat heat transfer tube, wherein:

a length of the second passage is equal to or shorter than a length of the first passage, and the first flat heat transfer tube and the second flat heat transfer tube connect to the joint through a side surface of the joint and communicate with an inner space of the joint, the inner space of the joint and side walls of the joint form a chamber to which the first flat transfer tube and the second flat transfer tube are connected, a portion of the chamber below each of the first flat heat transfer tube and the second flat heat transfer tube is a hollow portion receiving deposited sludge, the first flat heat transfer tube and the second flat heat transfer tube are disposed horizontally side-by-side relative to a top-to-bottom vertical direction of the condenser, and a region of the lower surface of the chamber below the first flat heat transfer tube has another hollow portion concaved downward relative to a region of a lower surface of the chamber below the second flat heat transfer tube.

2. The refrigeration cycle apparatus of claim 1, wherein refrigerating machine oil to which an epoxy compound is added is charged into the refrigeration cycle circuit.

3. The refrigeration cycle apparatus of claim 1, wherein the hollow portion is concaved downward.

4. The refrigeration cycle apparatus of claim 1, wherein the hydrofluoroolefin-based refrigerant is at least one of 2,3,3,3-tetrafluoropropene, 1,3,3,3-tetrafluoropropene, and 1,1,2-trifluoroethene, and wherein the at least one of the 2,3,3,3-tetrafluoropropene, the 1,3,3,3-tetrafluoropropene, and the 1,1,2-trifluoroethene is charged into the refrigeration cycle circuit.

5. The refrigeration cycle apparatus of claim 1, wherein the joint includes a separating wall that separates the chamber into a first chamber to which the first flat heat transfer tube connects and a second chamber to which the second flat heat transfer tube connects, and a third passage that penetrates through the separating wall, and wherein portions of the first chamber and the second chamber below the third passage serves as the hollow portion.

6. The refrigeration cycle apparatus of claim 5, wherein the third passage is disposed at a higher position than the first flat heat transfer tube.

7. The refrigeration cycle apparatus of claim 5, wherein the third passage is closer to the side surface of the chamber, to which the first flat heat transfer tube connects, than an end portion of the first flat heat transfer tube projecting into the chamber.

8. A refrigeration cycle apparatus comprising:

a refrigeration cycle circuit including a compressor, a condenser, and an expansion device; and hydrofluoroolefin-based refrigerant charged into the refrigeration cycle circuit, the condenser including:

a first passage connecting to the compressor at a first end and constituted of, at a second end, a first flat heat transfer tube including a plurality of passages thereof, a second passage connecting to the expansion device at a first end and constituted of, at a second end, a second flat heat transfer tube including a plurality of passages thereof, and a joint having a rectangular parallel piped shape joining the first flat heat transfer tube and the second flat heat transfer tube, enabling a flow of the hydrofluoroolefin-based refrigerant between the first flat heat transfer tube and the second flat heat transfer tube, wherein:

a length of the second passage is equal to or shorter than a length of the first passage, and the first flat heat transfer tube and the second flat heat transfer tube connect to the joint through a side surface of the joint and communicate with an inner space of the joint, the inner space of the joint and side walls of the joint form a chamber to which the first flat transfer tube and the second flat transfer tube are connected, the first flat heat transfer tube and the second flat heat transfer tube are arranged vertically with respect to each other in a top-to-bottom, vertical direction of the condenser, a portion of the chamber below one of the first flat heat transfer tube and the second flat heat transfer tube is a hollow portion receiving deposited sludge, the one of the first flat heat transfer tube and the second flat heat transfer tube, under which is the hollow portion, is disposed on a lower side of the other of the first flat heat transfer tube and the second flat heat transfer tube, a distance between a lower surface of the one of the first flat heat transfer tube and the second flat heat transfer tube under which is the hollow portion and which is disposed on the lower side and a lower surface of the chamber is larger than a distance between an upper surface of the other of the first flat heat transfer tube and the second flat heat transfer tube disposed on an upper side and an upper surface of the chamber, the chamber is the same chamber that connects the first flat heat transfer tube and the second flat heat transfer tube, and a distance between an end of the first flat heat transfer tube on the side connecting the first flat heat transfer tube to the chamber and a side surface of the chamber facing the end of the first flat heat transfer tube is smaller than a distance between an end of the second flat heat transfer tube on the side connecting the second flat heat transfer tube to the chamber and a side surface of the chamber facing the end of the second flat heat transfer tube.

9. A refrigeration cycle apparatus comprising:

a refrigeration cycle circuit including a compressor, a condenser, and an expansion device; and hydrofluoroolefin-based refrigerant charged into the refrigeration cycle circuit, the condenser including a first passage connecting to the compressor at a first end and constituted of, at a second end, a first flat heat transfer tube including a plurality of passages thereof, a second passage connecting to the expansion device at a first end and constituted of, at a second end, a second flat heat transfer tube including a plurality of passages thereof, and a joint joining the first flat heat transfer tube and the second flat heat transfer tube, bending a flow of the hydrofluoroolefin-based refrigerant between the first flat heat transfer tube and the second flat heat transfer tube, wherein:

a length of the second passage is equal to or shorter than a length of the first passage, and the joint is a U-shaped tube, and is formed with an inner wall including a recess that receives deposited sludge, the recess being formed outward in a direction perpendicular to longitudinal direction of the first flat heat transfer tube, an opening of the recess faces an inside space of the U-shaped tube, and the recess is concaved relative to a flat portion of the joint in which the recess is formed, and the joint being the U-shaped tube and the first flat heat transfer tube and the second heat transfer tube are connected by inserting one end portion of the first flat heat transfer tube into one end portion of the joint and inserting one end portion of the second flat heat transfer tube into an other end portion of the joint.

* * * * *